US010709201B2

(12) United States Patent
Auyang et al.

(10) Patent No.: US 10,709,201 B2
(45) Date of Patent: Jul. 14, 2020

(54) PIN ARRAY ADAPTIVE WEDGE

(71) Applicant: NIKE, Inc., Beaverton, OR (US)

(72) Inventors: Arick Auyang, Portland, OR (US); Gregory R. Leedy, Milwaukie, OR (US)

(73) Assignee: NIKE, Inc., Beaverton, OR (US)

( * ) Notice: Subject to any disclaimer, the term of this patent is extended or adjusted under 35 U.S.C. 154(b) by 162 days.

(21) Appl. No.: 15/259,705

(22) Filed: Sep. 8, 2016

(65) Prior Publication Data

US 2017/0071289 A1 Mar. 16, 2017

Related U.S. Application Data

(60) Provisional application No. 62/217,162, filed on Sep. 11, 2015, provisional application No. 62/237,628, filed on Oct. 6, 2015.

(51) Int. Cl.

| | |
|---|---|
| ***A43B 7/24*** | (2006.01) |
| ***A43B 7/28*** | (2006.01) |
| ***A43B 13/12*** | (2006.01) |
| ***A43B 13/20*** | (2006.01) |
| ***A43B 13/04*** | (2006.01) |
| ***A43B 13/18*** | (2006.01) |
| ***A43B 13/22*** | (2006.01) |
| ***A43B 13/32*** | (2006.01) |
| ***A43B 23/02*** | (2006.01) |

(52) U.S. Cl.

CPC ..... *A43B 13/20* (2013.01); *A43B 7/24* (2013.01); *A43B 7/28* (2013.01); *A43B 13/04* (2013.01); *A43B 13/12* (2013.01); *A43B 13/125* (2013.01); *A43B 13/127* (2013.01); *A43B 13/181* (2013.01); *A43B 13/185* (2013.01); *A43B 13/186* (2013.01); *A43B 13/188* (2013.01); *A43B 13/22* (2013.01); *A43B 13/32* (2013.01); *A43B 23/0235* (2013.01)

(58) Field of Classification Search

CPC .. A43B 7/146; A43B 7/24; A43B 7/28; A43B 13/127; A43B 13/18

USPC ..... 36/30 R, 141

See application file for complete search history.

(56) References Cited

U.S. PATENT DOCUMENTS 5,235,761 A * 8/1993 Chang ..... A43B 1/0072 36/137

5,502,901 A * 4/1996 Brown ..... A43B 1/0018 36/27

(Continued)

*Primary Examiner* — Sharon M Prange

(74) *Attorney, Agent, or Firm* — Honigman LLP; Matthew H. Szalach; Jonathan P. O'Brien

(57) ABSTRACT

An article of footwear is provided and includes an upper, an outsole, and a midsole. The outsole includes a ground-engaging surface and an inner surface. The midsole has a footbed, a bottom surface, and a series of channels extending therethrough. The bottom surface opposes the inner surface to define a cavity therebetween. The article of footwear also includes a series of pins each having a post extending through corresponding ones of the series of channels between a first end and a second end. The first end extends into the cavity outward from the bottom surface of the midsole and the second end extends into the interior void outward from the footbed of the midsole. The article of footwear also includes a resilient member that engages the first end of each of the series of pins and biases the series of pins toward the interior void.

19 Claims, 14 Drawing Sheets

(56) References Cited

U.S. PATENT DOCUMENTS

| | | | | |
|---|---|---|---|---|
| 5,682,690 | A * | 11/1997 | Chang | A43B 7/00 36/11.5 |
| 6,241,695 | B1 * | 6/2001 | Dabir | A61H 7/001 601/134 |
| 6,383,153 | B2 * | 5/2002 | Dabir | A61H 7/001 601/134 |
| 6,689,077 | B2 * | 2/2004 | Dabir | A61H 7/001 601/134 |
| 7,013,588 | B2 * | 3/2006 | Chang | A43B 1/0054 36/141 |
| 7,055,198 | B2 * | 6/2006 | Cadamuro | A43B 13/186 36/28 |
| 9,386,821 | B2 * | 7/2016 | Lambertz | A43B 7/146 |
| 2006/0213091 | A1 * | 9/2006 | Ometto | A43B 7/081 36/141 |
| 2008/0010868 | A1 * | 1/2008 | Tsai | A43B 1/0081 36/141 |
| 2016/0206043 | A1 * | 7/2016 | Cohen | A43B 7/146 |

* cited by examiner $L_{LAT}$
$L_C$
$L_C$
$L_C$
$L_C$
18
20
102
102
210
220
220
222
224
230
230
240
250
250
260
260
306
306
306
306
308
308
308
309
309
309
309
310
311
311
312
312
313
320
321
322
323
330
331
332
333
400
400
405
405
405
405
405
410
410
420
430

PIN ARRAY ADAPTIVE WEDGE

CROSS REFERENCE TO RELATED APPLICATIONS

This application claims priority to U.S. Provisional Patent Application Ser. No. 62/217,162, filed Sep. 11, 2015, and to U.S. Provisional Patent Application Ser. No. 62/237,628, filed Oct. 6, 2015, the entire contents of which are hereby incorporated by reference.

TECHNICAL FIELD

The present disclosure relates to an article of footwear and more particularly to an article of footwear incorporating features that facilitate banking during use.

BACKGROUND

This section provides background information related to the present disclosure which is not necessarily prior art.

Articles of footwear conventionally include an upper and a sole structure. The upper may be formed from any suitable material(s) to comfortably receive, secure, and support a foot on the sole structure. The upper may cooperate with laces, straps, or other fasteners to adjust the fit of the upper around the foot. A bottom portion of the upper, proximate to a bottom surface of the foot, is attached to the sole structure to provide an article of footwear that substantially surrounds a foot during use.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. Sole structures may also include a comfort-enhancing insole and/or a sockliner located within a void proximate to the bottom portion of the upper that receives a foot during use.

Conventional midsoles typically include a bottom surface disposed on one side that opposes the outsole and a footbed disposed on the opposite side that is contoured to conform to a profile of the bottom surface of the foot. The midsole may be formed from polymer foam materials that are designed with an emphasis on balancing cushioning characteristics relating to softness and responsiveness as the midsole compresses under gradient loads when a downward force is applied thereto, such as during walking or running movements. Midsoles may additionally or alternatively include a fluid-filled bladder that contains a pressurized fluid (e.g., air) that provides cushioning when the fluid-filled bladder compresses under gradient loads.

While a conventional midsole provides adequate cushioning for athletic activities such as running, such midsoles do not provide adaptive or changing support surfaces useful during lateral movements when playing sports such as basketball or tennis. During lateral movements, forces are generally applied to the midsole after the foot has rolled outward toward the lateral side or inward toward the medial side of the midsole. Often the foot is not adequately supported by the midsole by the time the midsole compresses during lateral movements, thereby leaving the foot without a surface on which to bank or push off for optimally performing the lateral movement. While midsoles generally balance responsiveness and support for the foot during typical walking or running movements, creating a midsole that balances responsiveness and support for the foot during lateral movements is difficult to achieve.

DRAWINGS

The drawings described herein are for illustrative purposes only of selected configurations and are not intended to limit the scope of the present disclosure.

Figure 13:
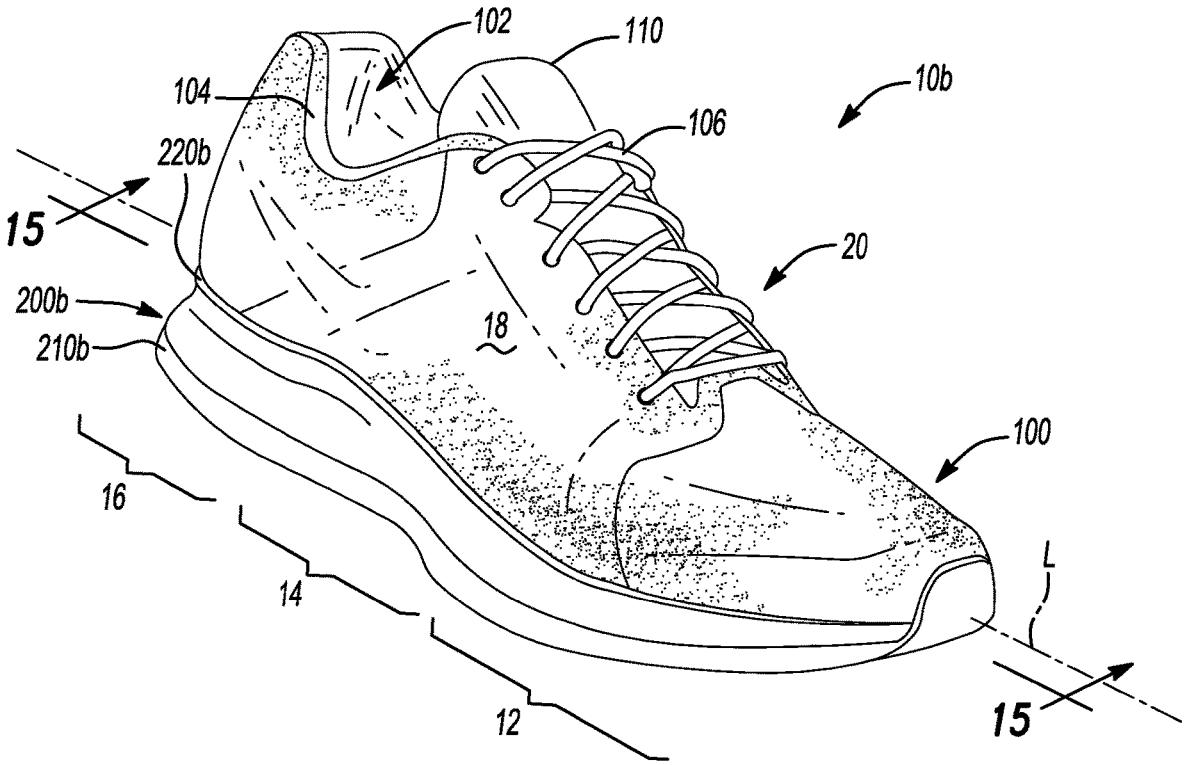
FIG. 13 is a top perspective view of an article of footwear in accordance with principles of the present disclosure.
Figure 14:
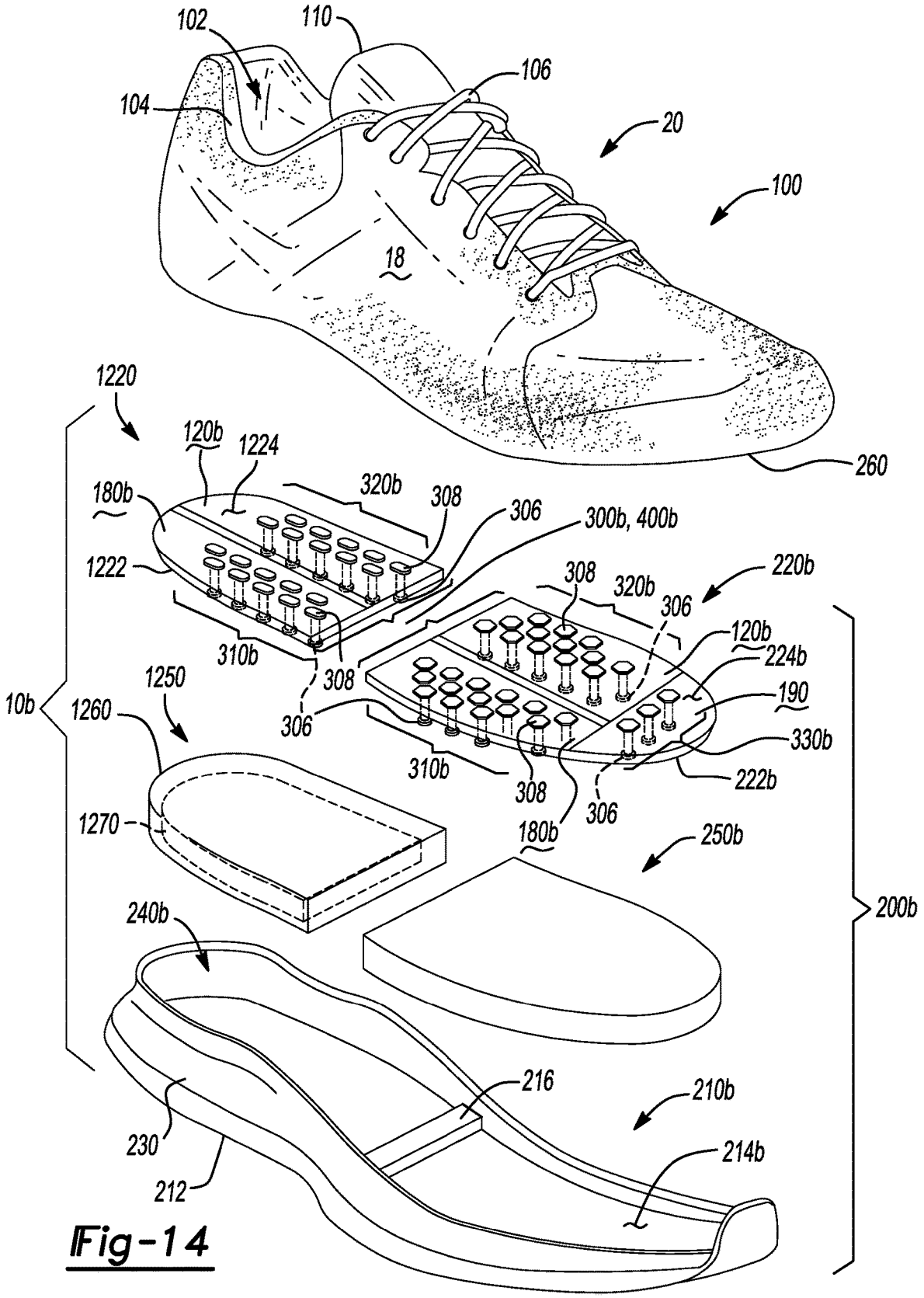
Figure 15:
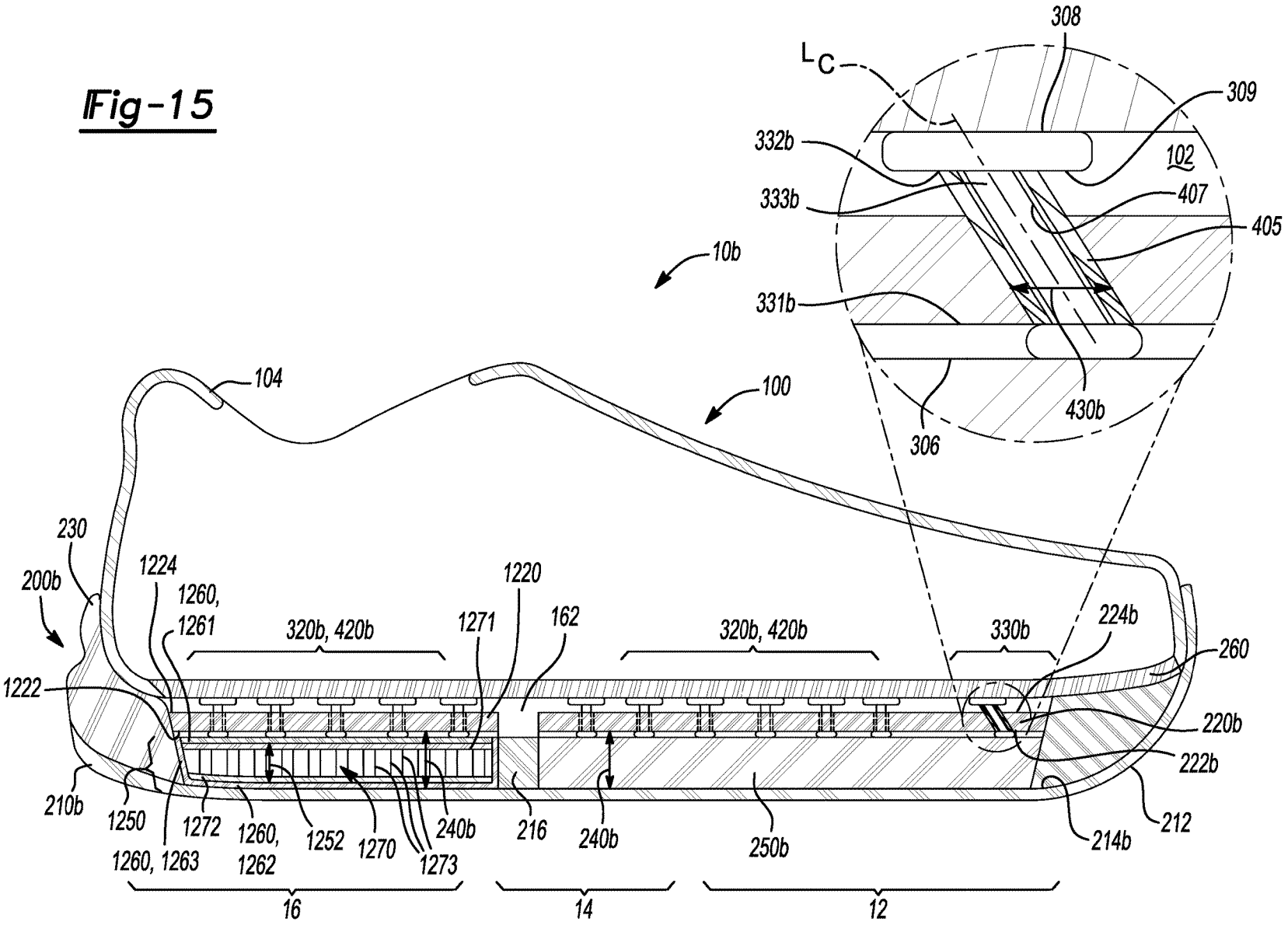
Figure 16:
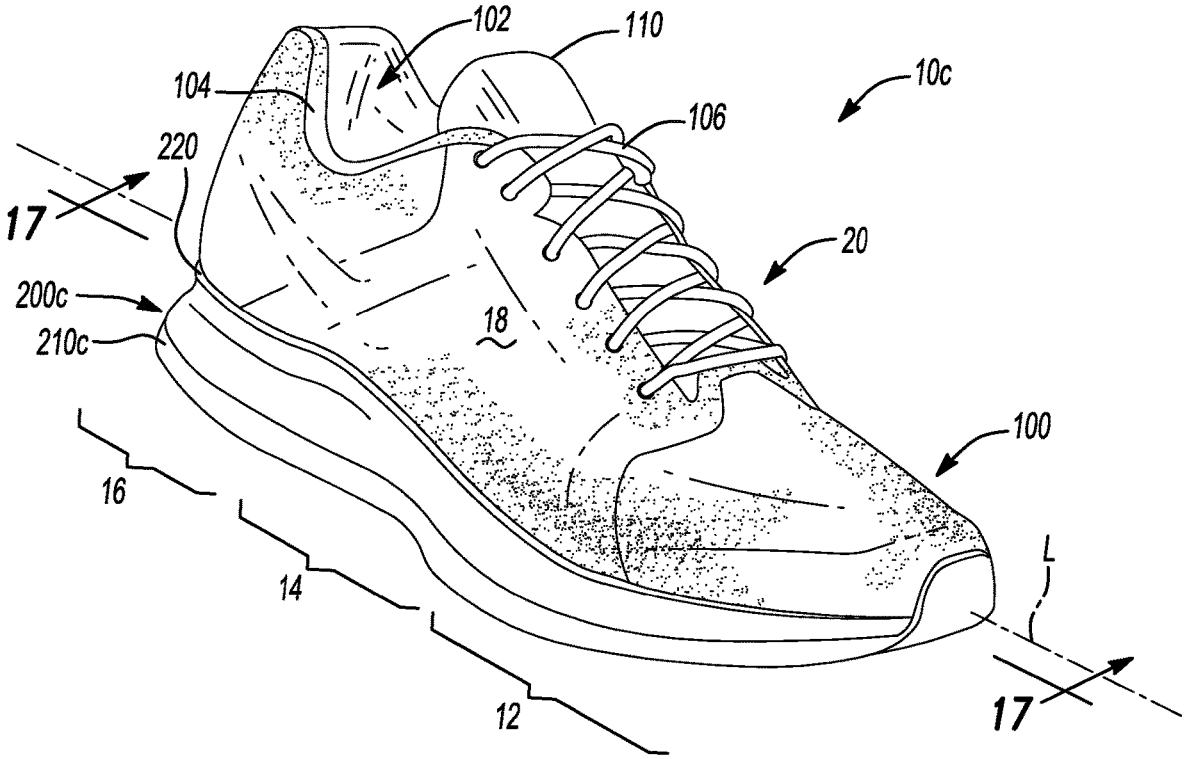
Figure 17:
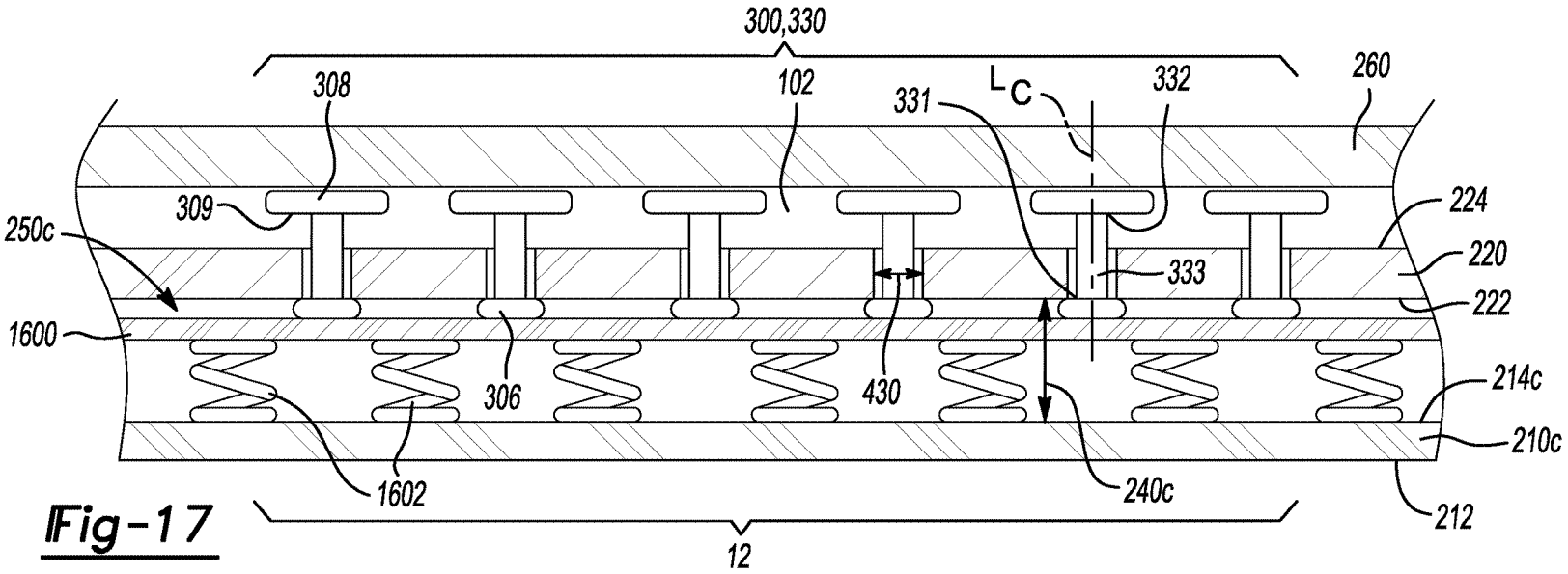
Figure 18:
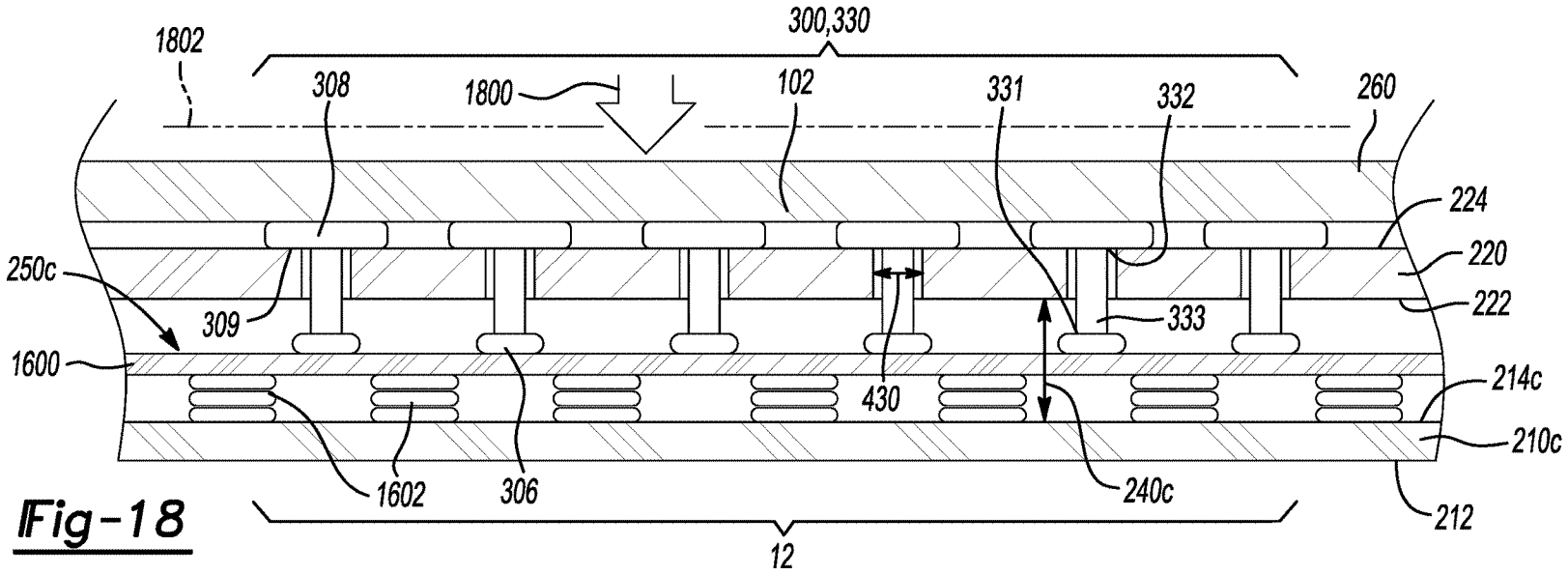

FIG. 14 is an exploded view of the article of footwear of FIG. 13 showing a first series of pins extending through a first midsole plate, a second series of pins extending through a second midsole plate, a first resilient member disposed between the first midsole plate and an inner surface of an outsole, and a second resilient member disposed between the second midsole plate and the inner surface of the outsole;

FIG. 15 is a cross-sectional view taken along line 15-15 of FIG. 13 showing a first series of pins extending through a first midsole plate, a second series of pins extending through a second midsole plate, a first resilient member disposed between the first midsole plate and an inner surface of an outsole, and a second resilient member disposed between the second midsole plate and the inner surface of the outsole;

FIG. 16 is a top perspective view of an article of footwear in accordance with principles of the present disclosure;

FIG. 17 is a cross-sectional view taken along line 17-17 of FIG. 13 showing a series of pins extending through a midsole and a biasing member disposed between the midsole and an inner surface of an outsole of a sole structure when the sole structure is at rest; and FIG. 18 is a cross-sectional view taken along line 17-17 of FIG. 13 showing a series of pins extending through a midsole and a biasing member disposed between the midsole and an inner surface of an outsole of a sole structure when the sole structure is under an applied load.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one aspect of the disclosure, an article of footwear is provided and includes an upper and an outsole attached to the upper. A ground-engaging surface and an inner surface are disposed on opposite sides of the outsole. A midsole of the article of footwear has a footbed, a bottom surface disposed on an opposite side of the midsole than the footbed, and a series of channels extending through the bottom surface and the footbed. The footbed opposes the upper to define an interior void therebetween and the bottom surface opposes the inner surface of the outsole to define a cavity therebetween. The article of footwear also includes a series of pins each having a post extending through corresponding ones of the series of channels between a first end and a second end. The first end of each pin extends into the cavity outward from the bottom surface of the midsole and the second end of each pin extends into the interior void outward from the footbed of the midsole. A resilient member is received within the cavity and engages the first end of each of the series of pins. The series of pins are biased by the resilient member in a first direction toward the interior void.

In some examples, each of the posts is permitted to move along a longitudinal axis of their respective channel. The channels may include different cross-sectional shapes than the posts. At least one of the channels may include a different cross-sectional shape than the other channels. In some examples, the channels include the same cross-sectional shape. In some configurations, a bushing is disposed within at least one of the series of channels. The bushing may include an inner surface that opposes and slidably receives the posts of the pins. The inner surface of the bushing may include a higher coefficient of friction than a material of the midsole. Additionally, the bushing may be formed from a harder material than the midsole.

In some implementations, the pins include a corresponding pin head disposed at the second end and a corresponding retention member disposed at the first end. In these implementations, the pin heads include an engagement surface opposing the footbed of the midsole and the retention members restrict removal of the series of pins from the series of channels. The pin heads may include at least one of a substantially circular cross-section and a substantially polygonal cross-section. In some examples, the engagement surfaces of the pin heads are disposed substantially parallel to a longitudinal axis of the midsole. Additionally or alternatively, at least one of the pin heads is disposed approximately the same distance from one of a lateral side and a medial side of the midsole as its respective first end. Optionally, at least one of the pin heads is disposed closer to a medial side of the midsole than its respective first end. In some examples, at least one of the pin heads of the series of pins is disposed closer to a lateral side of the midsole than its respective first end. Further, at least one of the pin heads of the series of pins is disposed farther from a tip of the midsole associated with toes of a foot than its respective first end. At least one of the pin heads may contact one or more adjoining pin heads to restrict rotational movement of the pin head. Additionally or alternatively, at least two of the series of pins are attached to one another to restrict rotational movement of the at least two pins.

In some configurations, the midsole includes a lateral zone located proximate to a lateral side of the midsole, a medial zone located proximate to a medial side of the midsole, and an interior zone disposed between the lateral zone and the medial zone. In some examples, a first portion of the series of pins is disposed within the lateral zone of the midsole and a second portion of the series of pins is disposed within the medial zone of the midsole. Optionally, a third portion of the series of pins may be disposed within the interior zone of the midsole. In some examples, the resilient member includes one of a polymer foam, a fluid-filled chamber, and a biasing member.

With reference to the figures and in one aspect of the disclosure, an article of footwear is provided and includes an upper and an outsole attached to the upper and including an inner surface. The article of footwear also includes a footbed opposing the upper to define an interior void therebetween and a bottom surface disposed on an opposite side of the midsole than the footbed and opposing the inner surface of the outsole to define a cavity therebetween. The midsole includes a lateral zone having a first series of channels extending through the bottom surface and the footbed and a medial zone having a second series of channels extending through the bottom surface and the footbed. The article of footwear also includes a first series of pins and a second series of pins. The first series of pins have a first post extending through corresponding ones of the first series of channels in a first direction substantially parallel to a longitudinal axis of the first post. The second series of pins have a second post extending through corresponding ones of the second series of channels in a second direction substantially parallel to a longitudinal axis of the second post.

In some configurations, the first direction of the first post and the second direction of the second post extend away from one another. Alternatively, the first direction and the second direction are converging. Conversely, in other configurations, the first direction is substantially parallel to the second direction.

Each one of the first series of pins and each one of the second series of pins may include a first end extending into the cavity outward from the bottom surface of the midsole and a second end extending into the interior void outward from the footbed of the midsole. Here, the second ends of the first series of pins are disposed closer to a lateral side of the midsole than their respective first ends and the second ends of the second series of pins are disposed closer to a medial side of the midsole than their respective first ends.

In some implementations, the article of footwear also includes a resilient member received within the cavity and biasing the first series of pins along the first direction toward the interior void. The resilient member may also bias the second series of pins along the second direction toward the interior void. In these implementations, the resilient member engages the first ends of the first series of pins and the first ends of the second series of pins. In some examples, at least one of the first series of pins is slidably movable along the first direction within its respective channel toward the resilient member when an axial compressive load is applied to the pin. Similarly, at least one of the second series of pins may also be slidably movable along the second direction within its respective channel toward the resilient member when an axial compressive load is applied to the pin.

The first series of pins and the second series of pins may also include a corresponding retention member disposed at the first ends. The retention members may restrict removal of the first series of pins from the first series of channels and may restrict removal of the second series of pins from the second series of channels. In some configurations, the first series of pins and the second series of pins include a corresponding pin head disposed at the second end. The pin heads may include an engagement surface opposing the footbed of the midsole. The engagement surfaces may be disposed substantially parallel to a longitudinal axis of the midsole. In some scenarios, at least one of the pin heads contacts one or more adjacent pin heads to restrict rotational movement of the pin heads. In some examples, the pin heads include at least one of a substantially circular cross-section and a substantially oval cross-section. Alternatively, the pin heads may include a substantially polygonal cross-section.

The first posts and the second posts may extend between the first end and the second end and may include different cross-sectional shapes than the channels. In some examples, each of the channels includes the same cross-sectional shape. In other examples, at least one of the channels includes a different cross-sectional shape than the other channels. The article of footwear may also include a bushing disposed within at least one of the first series of channels and the second series of channels. The bushing may include an inner surface that opposes and slidably receives respective ones of the first and second posts. Here, the inner surface includes a substantially higher coefficient of friction than a material of the midsole. For example, the bushing may be formed from a harder or different material than the midsole. In some configurations, at least two of the first series of pins are attached to one another to restrict rotational movement of at least two of the pins.

In some implementations, the midsole also includes an interior zone disposed between the lateral zone and the medial zone. In these implementations, the interior zone has a third series of channels extending through the bottom surface of the midsole. The third series of channels may each have a longitudinal axis extending substantially perpendicular to a longitudinal axis of the midsole. In some configurations, the article of footwear also includes a third series of pins each having a third post that extends through corresponding ones of the third series of channels and along the longitudinal axis of each corresponding third series channel. In these configurations, the resilient member may bias the third series of pins along a third direction substantially parallel to the longitudinal axis of the third series of channels toward the interior void. The third posts may include a shorter length than the first posts and the second posts. The resilient member may include one of a slab of polymer foam, a fluid-filled chamber, and a biasing member.

In another aspect of the disclosure, a method of making an article of footwear is provided and includes providing an interior void between an upper and a footbed of a midsole and providing a cavity between a bottom surface of the midsole and an outsole. The bottom surface is disposed on an opposite side of the midsole than the footbed. The method also includes providing the midsole with a series of channels extending through the bottom surface of the footbed and providing a series of pins each having a post extending through corresponding ones of the series of channels between a first end and a second end. The pins have a length that is greater than a thickness of the midsole. The method also includes biasing the series of pins in a direction toward the interior void.

In some implementations, the method includes biasing the series of pins in the first direction by engaging the first ends with a resilient member received within the cavity. Moreover, the method may include providing the series of pins having a post that is movable along a longitudinal axis of its respective channel. In some examples, the method includes providing the series of channels with the same cross-sectional shape. Alternatively, the method includes providing at least one of the channels with a different cross-sectional shape than the other of the channels.

In some configurations, the method also includes providing a bushing disposed within at least one of the series of channels. For example, the method may include providing the bushing with an inner surface opposing and slidably receiving the posts of the pins. In this example, the inner surface may include a higher coefficient of friction than a material of the midsole. Optionally, providing the bushing may include providing the bushing formed from a harder and/or different material than the midsole.

Providing the series of pins may include providing the series of pins with a corresponding retention member disposed at the first end and a corresponding pin head disposed at the second end. In so doing, the retention members may restrict removal of the series of pins from the series of channels and the pin heads may have an engagement surface opposing the bottom surface of the midsole. In some examples, providing the series of pins with a corresponding pin head includes providing the series of pins with a corresponding pin head that includes at least one of a substantially circular cross-section and a substantially polygonal cross-section. Additionally or alternatively, providing the series of pins with a corresponding pin head having an engagement surface may include providing the series of pins with a corresponding pin head having an engagement surface that is disposed substantially parallel to a longitudinal axis of the midsole. For example, the method may include providing at least one of the series of pins with a corresponding pin head that is disposed approximately the same distance from one of a lateral side and a medial side of the midsole than its respective first end. Additionally or alternatively, the method may include providing at least one of the series of pins with a corresponding pin head that is disposed closer to a medial side of the midsole than its respective first end. Additionally or alternatively, the method may include providing at least one of the series of pins with a corresponding pin head that is disposed closer to a lateral side of the midsole than its respective first end.

In some configurations, the method includes providing at least one of the series of pins with a corresponding pin head that is disposed farther from a tip of the midsole associated with toes of a foot than its respective first end. The method may also include providing at least one of the series of pins with a corresponding pin head that contacts one or more adjacent pin heads to restrict rotational movement of the pin heads. In some implementations, providing the series of pins includes attaching at least two of the series of pins to one another to restrict rotational movement of the at least two of the series of pins.

In some configurations, the method may include providing the midsole with a lateral zone located proximate to a lateral side of the midsole, a medial zone located proximate to a medial side of the midsole, and an interior zone disposed between the lateral zone and the medial zone. In these configurations, providing the series of pins includes providing a first portion of the series of pins disposed within the lateral zone of the midsole and providing a second portion of the series of pins disposed within the medial zone of the midsole. The method may also include providing a third portion of the series of pins within the interior zone of the midsole. In some implementations, the method may also include providing a resilient member within the cavity that includes one of a slab of polymer foam, a fluid-filled chamber, and a biasing member.

Referring to FIGS. 1-7, an article of footwear 10 is provided and includes an upper 100 and a sole structure 200 attached to the upper 100. The article of footwear 10 may be divided into one or more portions including a forefoot portion 12, a mid-foot portion 14, and a heel portion 16. The forefoot portion 12 may correspond with toes and joints connecting metatarsal bones with phalanx bones of a foot. The mid-foot portion 14 may correspond with an arch area of the foot, and the heel portion 16 may correspond with rear portions of the foot, including the calcaneus bone. The footwear 10 may include a lateral side 18 and a medial side 20 corresponding with opposite sides of the footwear 10 and extending through the portions 12, 14, 16.

The upper 100 defines an interior void 102 that receives and secures a foot for support on the sole structure 200. An ankle opening 104 located in the heel portion 16 may provide access to the interior void 102. For example, the ankle opening 104 may receive a foot to secure the foot within the void 102 and facilitate entry and removal of the foot from and to the interior void 102. In some examples, one or more fasteners 106 extend along the upper 100 to adjust a fit of the interior void 102 around the foot while concurrently accommodating entry and removal of the foot therefrom. The upper 100 may include apertures such as eyelets and/or other engagement features such as fabric or mesh loops that receive the fasteners 106. The fasteners 106 may include laces, straps, cords, hook-and-loop, or any other suitable type of fastener.

The upper 100 may additionally include a tongue portion 110 that extends between the interior void 102 and the fasteners 106. The upper 100 may be formed from one or more materials that are stitched or adhesively bonded together to form the interior void 102. Suitable materials of the upper may include, but are not limited to, textiles, foam, leather, and synthetic leather. The materials may be selected and located to impart properties of durability, air-permeability, wear-resistance, flexibility, and comfort to the foot while disposed within the interior void 102.

In some configurations, the sole structure 200 includes an outsole 210, a resilient member 250, and a midsole 220 arranged in a layered configuration. The outsole 210 is generally positioned on a bottom surface of the article of footwear 10 to allow the outsole 210 to contact a ground surface during use. The resilient member 250 is disposed between the midsole 220 and the outsole 210 and provides a degree of cushioning to the foot during use of the article of footwear 10. The interior void 102 may be defined between the upper 100 and the midsole 220. In some examples, the sole structure 200 may also incorporate additional layers such as an insole 260 or sockliner. The insole 260 may reside on the midsole 220 within the interior void 102 of the upper 100 and may receive a plantar surface of the foot to enhance the comfort of the footwear 10. In some examples, a sidewall 230 separates the outsole 210 and the midsole 220 to define a cavity 240 therebetween.

In some implementations, a series of pins 300 extend through the midsole 220 to support the foot as well as to provide banking surfaces for use during lateral or side-to-side movements. The midsole 220 may define a length extending along a longitudinal axis L and through the forefoot, mid-foot, and heel portions 12, 14, 16, respectively, of the sole structure 200. The resilient member 250 may define a length substantially equal to the length of the midsole 220. The resilient member 250 and the series of pins 300 may cooperate to enhance functionality, support, and cushioning characteristics that a conventional midsole provides. For example, the resilient member 250 may bias the series of pins 300 in a first direction toward the interior void 102 and at least one of the series of pins 300 may be slidably movable in an opposite second direction toward the resilient member 250 when an axial compressive load is applied to the at least one pin 300 in response to a ground-reaction force. The compressive load may depress the resilient member 250 to provide resilient compressibility to attenuate the ground-reaction force. Accordingly, pins 300 not under an axial compressive load may remain biased toward the interior void 102 to provide a banking surface for the foot for use during lateral movements, as will be described below. As used herein, a banking surface refers to a surface of the sole structure 200 that is held against an area or region of the bottom surface of the foot to provide stability for the foot in the associated area or region. More specifically, the banking surface(s) provided by the pins 300 and the resilient member 250 enhance performance of the footwear 10 by providing a surface against which the foot may react during a lateral or cutting motion.

In addition to providing banking surfaces, the series of pins 300 and the resilient member 250 may cooperate to correct over supination and/or over pronation. Over supination or hyper-supination refers to an insufficient inward role of the foot when the outsole 210 contacts a ground surface during a walking or running movement. Over pronation, on the other hand, refers to excessive inward rolling of the foot as the outsole 210 rolls for engagement with the ground surface during a walking or running movement after the heel portion 16 of the outsole 210 (e.g., lateral side 18) makes initial contact with the ground, thereby resulting in the foot pushing off the ground surface almost completely from the big toe and the second toe. The surfaces created by cooperation of the pins 300 and the resilient member 250 may provide support to the foot in specific regions, thereby restricting movement of the foot and reducing over supination and/or over pronation, as will be described below.

Figure 1:
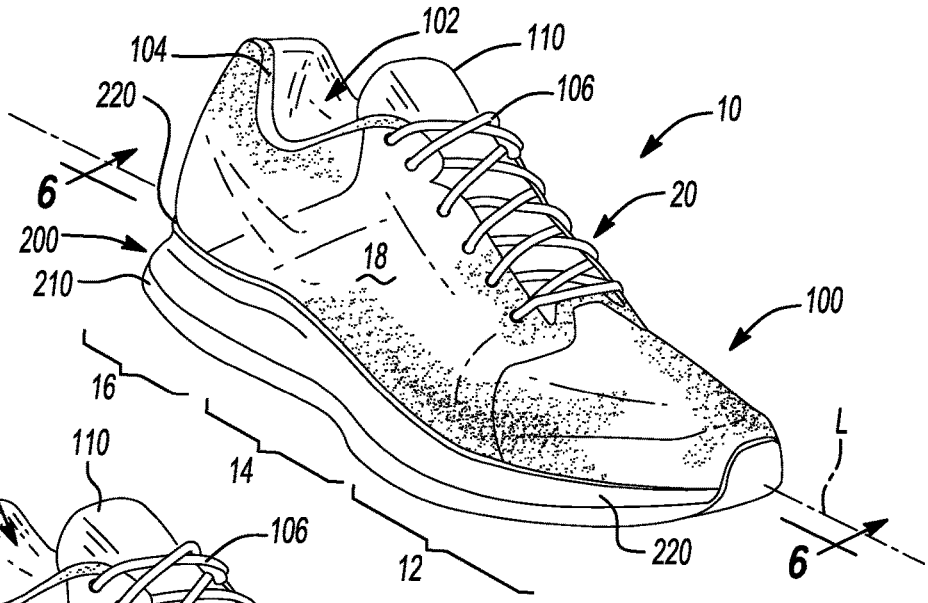
FIG. 1 is a top perspective view of an article of footwear in accordance with principles of the present disclosure.
Figure 1:
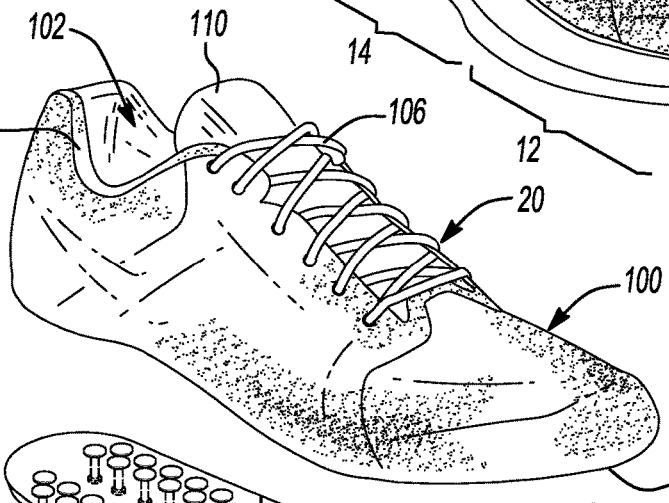

In some examples, the outsole 210 includes a ground-engaging surface 212 and an opposite, inner surface 214. The outsole 210 may be attached to the upper 100, as shown in FIG. 1. Namely, the sidewall 230 extends from the perimeter of the outsole 210 and attaches to the midsole 220 and/or the upper 100. The example of FIG. 1 shows the outsole 210 attaching to the upper 100 proximate to a tip of the forefoot portion 12. The outsole 210 generally provides abrasion-resistance and traction with the ground surface. Accordingly, the outsole 210 may be formed from one or more materials that impart durability and wear-resistance, as well as enhance traction with the ground surface. For example, rubber may form at least a portion of the outsole 210.

The midsole 220 may include a bottom surface 222 and a footbed 224 disposed on an opposite side of the midsole 220 than the bottom surface 222. In some examples, the midsole 220 is formed from a substantially rigid material and exhibits characteristics corresponding to a conventional stroble. For example, stitching and/or adhesives may secure the midsole 220 to the upper 100. The footbed 224 may be contoured to conform to a profile of the bottom surface (e.g., plantar) of the foot. In some examples, the insole 260 or sockliner may be disposed under the foot within at least a portion of the interior void 102 of the upper 100 and may oppose the footbed 224.

The bottom surface 222 may oppose the inner surface 214 of the outsole 210 to define the cavity 240 therebetween. In some examples, the sidewall 230 may define a perimeter of the cavity 240 as well as a depth of the cavity 240 based on a length of separation between the bottom surface 222 of the midsole 220 and the inner surface 214 of the outsole 210. The resilient member 250 may be disposed on the inner surface 214 of the outsole 210 and may occupy a portion of the cavity 240. One or more polymer foam materials may form the sidewall 230 to provide resilient compressibility under an applied load to attenuate ground-reaction forces.

Figure 2:
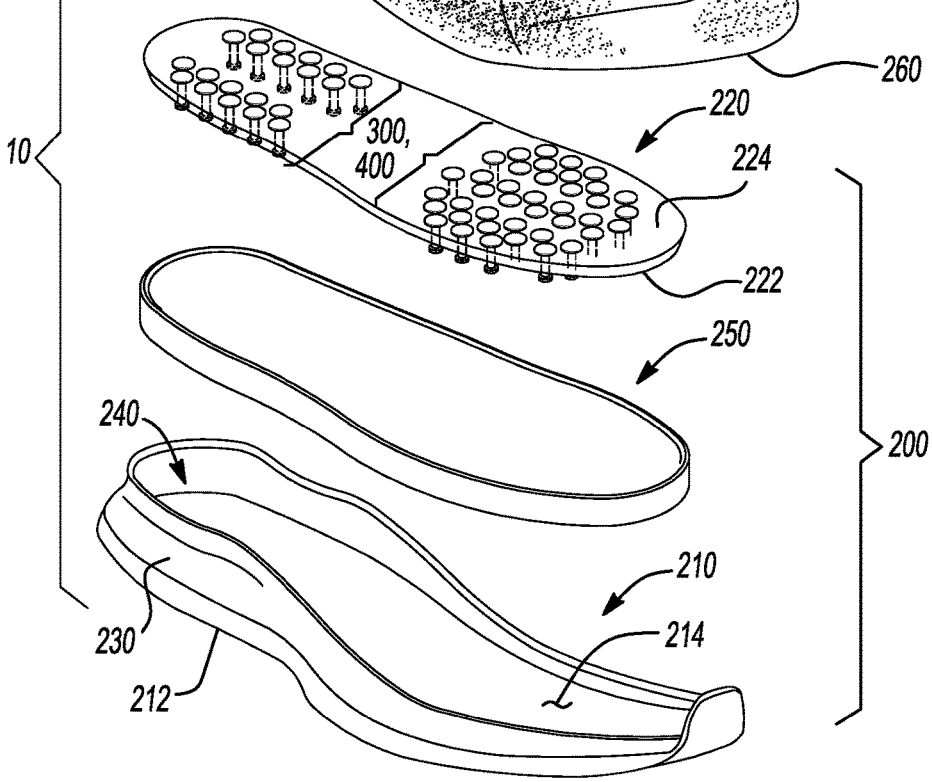
FIG. 2 is an exploded view of the article of footwear of FIG. 1 showing a series of pins extending through a midsole and a resilient member disposed between the midsole and an inner surface of an outsole.
Figure 4:
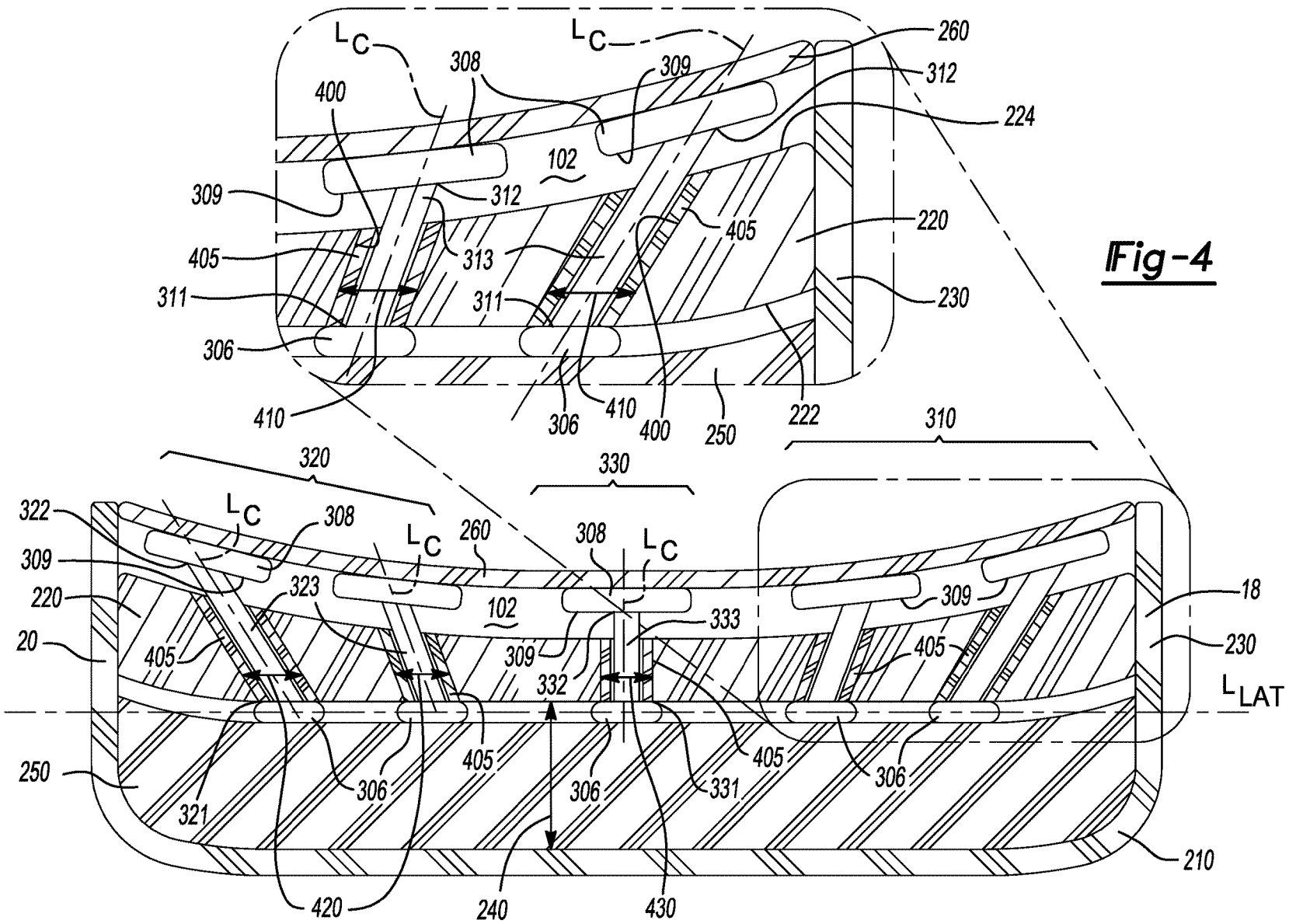
FIG. 4 is a cross-sectional view taken along line 4-4 of FIG. 3 showing a series of pins extending through a midsole and a resilient member disposed between the midsole and an inner surface of an outsole.
Figure 5:
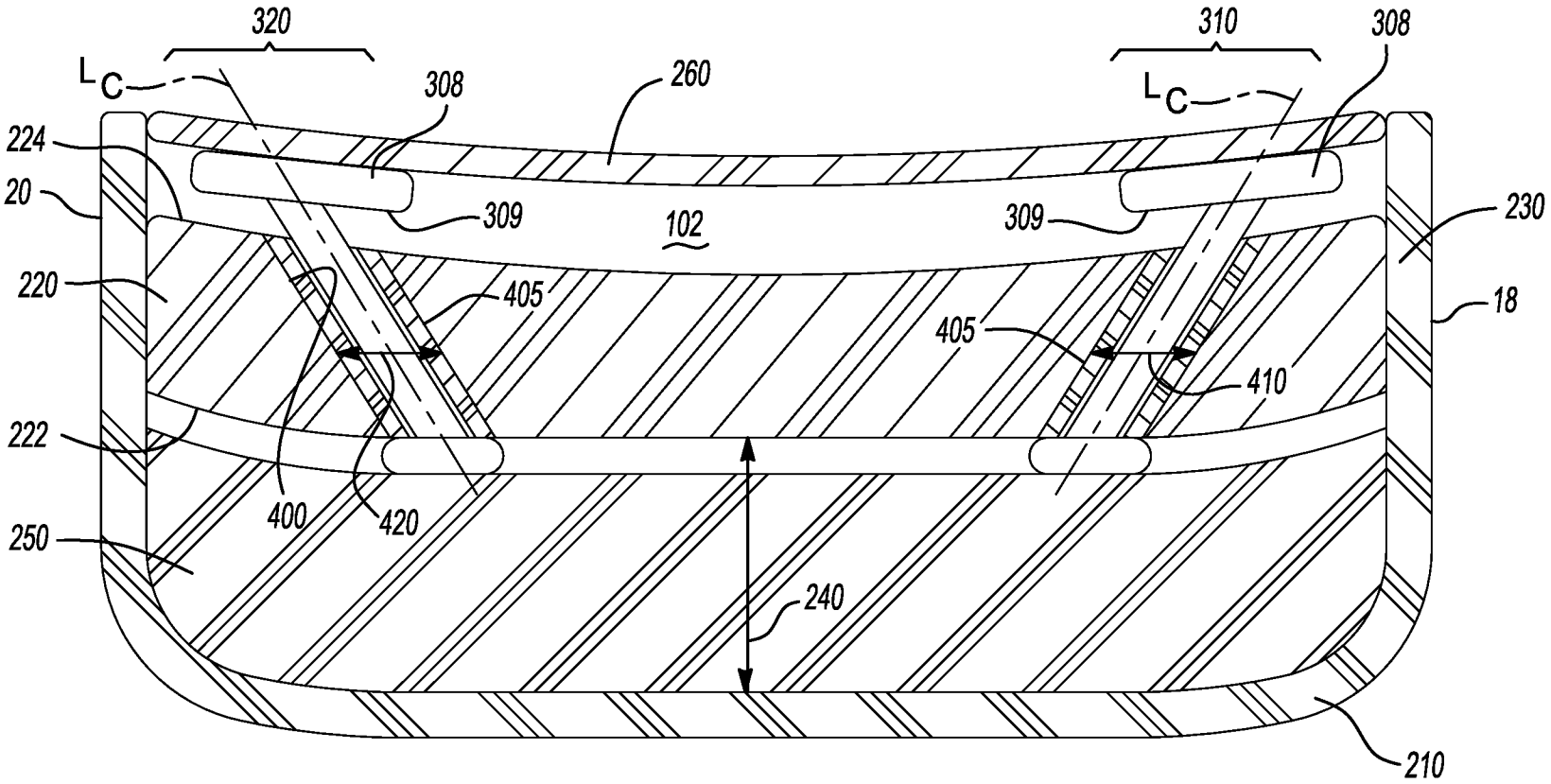
FIG. 5 is a cross-sectional view taken along line 5-5 of FIG. 3 showing a bushing disposed within a channel of a midsole and including an inner surface opposing and slidably receiving one of the series of pins extending through the channel.

FIG. 2 provides an exploded view of the article of footwear 10 showing the series of pins 300 extending through the midsole 220 and the resilient member 250 disposed between the bottom surface 222 of the midsole 220 and the inner surface 214 of the outsole 210. The midsole 220 may include a series of channels 400 extending through the footbed 224 and the bottom surface 222, and each pin 300 may have a post that extends through corresponding ones of the series of channels 400 between a first end and a second end. The first end of each pin 300 may extend into the cavity 240 outward from the bottom surface 222 of the midsole 220 and the second end of each pin 300 may extend into the interior void 102 outward from the footbed 224 of the midsole 220, as shown in FIGS. 4 and 5. The pins 300 may therefore have a length that is greater than a thickness of the midsole 220. The resilient member 250 may be received within the cavity 240 and may engage the first end of each pin 300 to bias the series of pins 300 in the first direction toward the insole 260 within the interior void 102.

Figure 3:
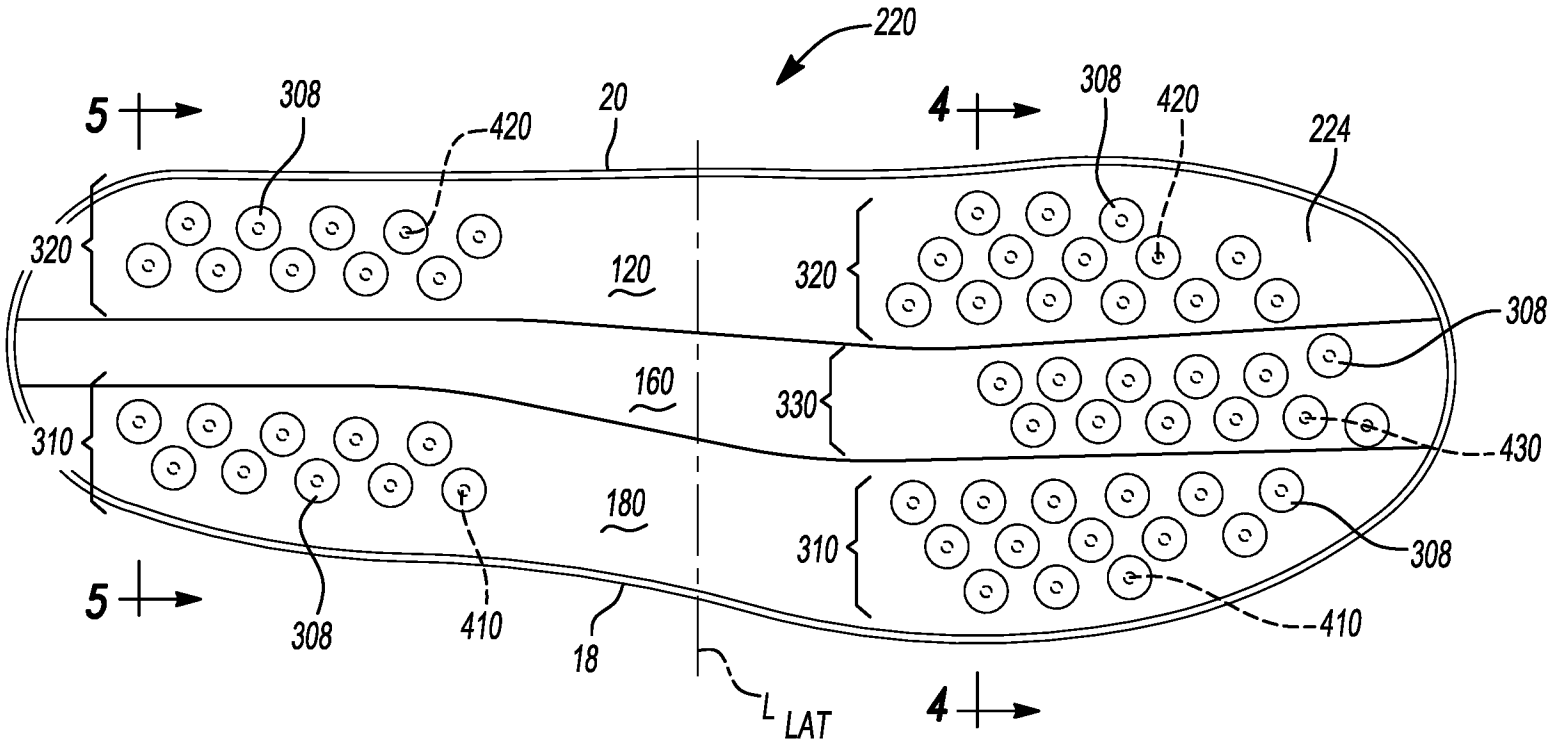
FIG. 3 is a top view of the midsole of FIG. 2 showing a series of pins each having a pin head extending through a footbed of the midsole.

FIG. 3 provides a top view of the midsole 220 of FIG. 2 showing the series of pins 300 each having a pin head 308 extending from the footbed 224 of the midsole 220 and located at the second end of each pin 300. The midsole 220 may define a lateral axis $L_{LAT}$ extending between the lateral side 18 and the medial side 20. The series of pins 300 may collectively include a first series of pins 310, a second series of pins 320, and a third series of pins 330. In some implementations, the midsole 220 includes a lateral zone 180 located proximate to the lateral side 18 of the footwear 10, a medial zone 120 located proximate to the medial side 20 of the footwear 10, and an interior zone 160 disposed between the lateral zone 180 and the medial zone 120. In some examples, the first series of pins 310 are disposed within the lateral zone 180 of the midsole 220 and the second series of pins 320 are disposed within the medial zone 120 of the midsole 220. The third series of pins 330 may additionally or alternatively be disposed within the interior zone 160 of the midsole 220. The pin heads 308 associated with respective ones of the series of pins 310, 320, 330 may include a substantially circular cross-section as shown in FIG. 3. Other configurations, however, may include at least one of the pin heads 308 having a substantially oval cross-section, a substantially polygonal cross-section, or any combination thereof. FIG. 3 shows each series of pins 310, 320, 330 located within the forefoot portion 12 and the mid-foot portion 14 of the midsole 220, while the heel portion 16 of the midsole 220 only includes the first series of pins 310 and the second series of pins 320.

In some implementations, the lateral zone 180 of the midsole has a first series of channels 410 extending through the bottom surface 222 and the footbed 224 and the medial zone 120 of the midsole 220 has a second series of channels 420 extending through the bottom surface 222 and the footbed 224. Additionally, the forefoot portion 12 and the mid-foot portion 14 of the midsole 220 may include a third series of channels 430 located within the interior zone 160 and extending through the bottom surface 222 and the footbed 224.

Referring to FIG. 4 a cross-sectional view taken along line 4-4 of FIG. 3 shows each series of pins 310, 320, 330 extending through the forefoot portion 12 and between the lateral side 18 and the medial side 20 of the midsole 220. Specifically, the first series of pins 310 each have a first post 313 extending through corresponding ones of the first series of channels 410 in a first direction substantially parallel to a longitudinal axis $L_C$ of the first post 313, the second series of pins 320 each have a second post 323 extending through corresponding ones of the second series of channels 420 in a second direction substantially parallel to a longitudinal axis $L_C$ of the second post 323, and the third series of pins 330 each have a third post 333 extending through corresponding ones of the third series of channels 430 in a third direction substantially parallel to a longitudinal axis $L_C$ of the third post 333.

The first posts 313 of the first series of pins 310 may extend between a first end 311 and a second end 312. The first end 311 extends into the cavity 240 outward from the bottom surface 222 of the midsole 220 and the second end 312 extends toward the insole 260 (within the interior void 102) outward from the footbed 224 of the midsole 220. The corresponding pin head 308 of each pin 300 is disposed at the second end 312 and a corresponding retention member 306 is disposed at the first end 311. Each pin head 308 may include a corresponding engagement surface 309 that opposes the footbed 224. The retention members 306 include a size and/or shape that restrict the retention members 306 from being pulled through the midsole 220.

The second posts 323 of the second series of pins 320 may extend between a first end 321 and a second end 322. The first end 321 extends into the cavity 240 outward from the bottom surface 222 of the midsole 220 and the second end 322 extends toward the insole 260 (within the interior void 102) outward from the footbed 224 of the midsole 220. The corresponding pin head 308 of each pin 300 of the second series of pins 320 is disposed at the second end 322 and a corresponding retention member 306 is disposed at the first end 321. Each pin head 308 may include a corresponding engagement surface 309 that opposes the footbed 224. As with the first series of pins 300, the retention members 306 of the second series of pins 320 include a size and/or shape that restrict the retention members 306 from being pulled through the midsole 220.

The third posts 333 of the third series of pins 330 may extend between a first end 331 and a second end 332. The first end 331 extends into the cavity 240 outward from the bottom surface 222 of the midsole 220 and the second end 322 extends toward the insole 260 (within the interior void 102) outward from the footbed 224 of the midsole 220. The corresponding pin head 308 of each pin 300 of the third series of pins 330 is disposed at the second end 332 and a corresponding retention member 306 is disposed at the first end 331. Each pin head 308 may include a corresponding engagement surface 309 that opposes the footbed 224. The retention members 306 of the third series of pins 330 include a size and/or shape that restrict the retention members 306 from being pulled through the midsole 220.

In some configurations, the first direction (associated with the longitudinal axis $L_C$ of the first posts 313) and the second direction (associated with the longitudinal axis $L_C$ of the second posts 323) extend away from one another toward the insole 260 at the associated second ends 312, 322 and converge toward one another at the associated first ends 311, 321 toward the cavity 240. Accordingly, the second ends 312 (e.g., pin heads 308) of the first series of pins 300 are disposed closer to the lateral side 18 of the midsole 220 than their respective first ends 311 (e.g., retention members 306) and the second ends 322 (e.g., pins heads 308) of the second series of pins 320 are disposed closer to the medial side 20 of the midsole 220 than their respective first ends 321 (e.g., retention members 306). Based on the foregoing, the pin heads 308 of the pins 300 are disposed closer to the lateral side 18 of the midsole 220 when the pins 300 are in the extended state than when the pins 300 are in the retracted state (i.e., moved in a direction along the longitudinal axis $L_C$ toward the resilient member 250). Similarly, the pin heads 308 of the pins 320 are disposed closer to the medial side 20 of the midsole 220 when the pins 320 are in the extended state than when the pins 320 are in the retracted state (i.e., moved in a direction along the longitudinal axis $L_C$ toward the resilient member 250).

The third direction (associated with the longitudinal axis $L_C$ of the third posts 333) extends substantially perpendicular to the longitudinal axis L and the lateral axis $L_{LAT}$ of the midsole 220. Thus, the second ends 332 (e.g., pin heads 308) of the third series of pins 330 are disposed approximately the same distance from one of the lateral side 18 and the medial side 20 of the midsole 220 as their respective first ends 331 (e.g., retention members 306).

In some implementations, the posts 313, 323, 333 are permitted to slidably move relative to and within their respective channel 410, 420, 430 relative to the midsole 220 and also relative to one another. Movement of the posts 313, 323, 333 relative to and within the respective channels 410, 420, 430 is dictated by the length of the respective posts 313, 323, 333 (i.e., between the respective retention members 306 and pin heads 308). Namely, the retention members 306 and pin heads 308 each include a size and/or shape that restrict removal of the posts 313, 323, 333 from the midsole 220 and, as such, define a range of motion of the posts 313, 323, 333 relative to the midsole 220 within and along the respective channels 410, 420, 430.

The resilient member 250 may engage the first ends 311, 321, 331 at the retention members 306, thereby biasing each of the pins 310, 320, 330 along their associated directions toward the insole 260 and into an extended state. When axial compressive loads are applied to the pins 310, 320, 330, however, the pins 310, 320, 330 slidably move along their associated directions toward the resilient member 250 into a retracted state, thereby depressing and causing the resilient member 250 to resiliently compress to attenuate a ground-reaction force. As used herein, an axial compressive load refers to a force applied in a direction substantially parallel to the longitudinal axis $L_C$ associated with any of the posts 313, 323, 333 and/or substantially normal to the pin heads 308.

The series of pins 310, 320, 330 may move relative to one another depending on whether or not axial compressive loads are being applied thereto. For instance, an axial compressive load applied to the first series of pins 310 may only result in the first series of pins 310 moving toward the resilient member 250, while the second series of pins 320 and the third series of pins 330 remain in their extended state to provide banking surfaces for use during lateral movements. Pins 300 associated with the same series may also move relative to one another depending on whether or not axial compressive loads are being applied to each of the individual pins 300 within the particular series of pins.

The engagement surfaces 309 of the pin heads 318, 328, 339 may be disposed substantially parallel to the lateral axis $L_{LAT}$ of the midsole 220. Hence, the third posts 333 of the third series of pins 330 are associated with a longitudinal axis $L_C$ extending substantially perpendicular to the their respective engagement surfaces 309, while the first posts 313 of the first series of pins 310 and the second posts 323 of the second series of pins 320 are each associated with a respective longitudinal axis $L_C$ that is angled relative to the lateral axis $L_{Lat}$ of the midsole 220 (e.g., the second ends 312, 322 extend away from one another and the first ends 311, 321 converge toward one another).

Forming the first posts 313 of the first series of pins 310 at an angle relative to the respective pin heads 308 may restrict the pins from moving relative to the midsole 220 unless a force (e.g., axial compressive load) is applied in a direction substantially parallel to the longitudinal axis $L_C$ of each first post 313 and/or substantially normal to the pin head 308. Accordingly, the first series of pins 310 may be restricted from depressing the resilient member 250 unless the axially compressive load is applied thereto in a direction substantially parallel to the longitudinal axis $L_C$ of each first post 313 and/or substantially normal to the pin head 308 and, therefore, the first series of pins 310 may remain in the extended state to provide a banking surface at the lateral side 18 of the midsole 220 for use during lateral movements. For example, if an axial compressive force is applied to the midsole 220 in a direction substantially parallel to the longitudinal axis $L_C$ of the second posts 320, the second posts 320 will move in a direction toward the resilient member 250 and toward the inner surface 214 of the outsole 210 while the same force applied to the first pins 310 does not cause similar movement. Accordingly, the first pins 310 remain in the extended state shown in FIG. 4 to provide a baking surface against which the foot may react when making a side-to-side or lateral movement. In this position, the load applied to the first pins 310 is in a direction that is somewhat normal or perpendicular to a longitudinal axis the first posts 313. As such, the posts 313 are urged in a direction toward the lateral side 18 but do not move toward the resilient member 250. Rather, the posts 313 may engage areas of the midsole 220 disposed around each post 313, thereby causing the posts 313 to be trapped or temporarily fixed in the extended state relative to the midsole 220. In so doing, the posts 313—along with the respective pin heads 308—provide a banking surface that enhances the ability of the user to move in a side-to-side or lateral direction.

In some examples, the angle of the first posts 313 relative to the respective pin heads 308 increases for pins 310 disposed closer to the lateral side 18 of the midsole 220 to enhance the dynamics and balancing provided by the banking surface. Additionally or alternatively, the length of the posts 313 may gradually increase toward the lateral side 18 of the midsole 220 to provide a level of inclination for the associated banking surface provided in the lateral zone 180.

As described above, the first series of pins 310 may provide a banking surface for the foot in the lateral zone 180 while in the extended state. However, when an axial compressive load is applied to the first series of pins 310 to overcome the biasing of the resilient member 250, the first series of pins 310 are caused to transition to the retracted state by slidably moving toward and depressing the resilient member 250, thereby causing the resilient member 250 to resiliently compress at the location proximate to the lateral side 18 of the footwear 10 when a lateral movement is directed to the lateral side 18 of the footwear 10. In doing so, the second series of pins 320 and the third series of pins 330 may be in their extended states to provide banking surfaces for the foot during transitional lateral movements from the lateral side 18 of the footwear 10. In other words, when a force is applied to the first pins 310 in a direction substantially parallel to the longitudinal axis $L_C$ of the first posts 313, the first pins 310 move toward and compress the resilient member 250 while the second pins 320 remain in the extended state to provide a banking surface.

Forming the second posts 323 of the second series of pins 320 at an angle relative to the respective pin heads 308 may restrict the pins from moving relative to the midsole 220 unless a force (e.g., axial compressive load) is applied to the pins 320 in a direction substantially parallel to the longitudinal axis $L_C$ of each second post 323 and/or in a direction substantially perpendicular or normal to the pin heads 308. Accordingly, the second series of pins 320 may be restricted from depressing the resilient member 250 unless the axially compressive load is applied thereto and, therefore, the second series of pins 320 may remain in the extended state to provide a banking surface at the medial side 20 of the midsole 220 for use during lateral movements. In some examples, the angle of the second posts 323 relative to the respective pin heads 308 increases for pins 320 disposed closer to the medial side 20 of the midsole 220 to enhance the dynamics and balancing provided by the banking surface. Additionally or alternatively, the length of the posts 323 may gradually increase toward the medial side 20 of the midsole 220 to provide a level of inclination for the associated banking surface provided in the medial zone 120.

Accordingly, the second series of pins 320 may provide a banking surface for the foot in the medial zone 120 while in the extended state. However, when an axial compressive load is applied to the second series of pins 320 to overcome the biasing of the resilient member 250, the second series of pins 320 are caused to transition to their retracted state by slidably moving toward and depressing the resilient member 250. In so doing, the resilient member 250 compresses at the location proximate to the medial side 20 of the footwear 10 during lateral movements directed to the medial side 20 of the footwear 10. During such movements, the first series of pins 310 and the third series of pins 330 may be in their extended states to provide banking surfaces for the foot during transitional lateral movements from the medial side 20 of the footwear 10.

The third series of pins 330 may also provide a banking surface for the foot in the interior zone 160 while in the extended state. However, when an axial compressive load is applied to the third series of pins 330 to overcome the biasing of the resilient member 250, the third series of pins 330 are caused to transition to a retracted state by slidably moving toward and depressing the resilient member 250. As with the first series of pins 310 and the second series of pins 320, movement of the third series of pins 330 toward the resilient member 250 causes the resilient member 250 to resiliently compress at interior regions of the footwear 10 between the lateral side 18 and the medial side 20 when movements, such as running or walking, cause a ground-reaction force to be applied at the interior regions of the footwear 10. In doing so, the first series of pins 310 and the second series of pins 320 may be in their extended states to provide banking surfaces for the foot during lateral movements toward the lateral side 18 and/or the medial side 20 of the footwear 10.

As described, the first series of pins 310, the second series of pins 320, and the third series of pins 330 are independently movable. Accordingly, portions of each series 310, 320, 330 may be moved depending on the applied load. For example, during a forward walking or running movement, forces may be applied to the insole 260 and, thus, to the pin heads 308 of each series 310, 320, 330 in a direction substantially perpendicular to the insole 260 and each pin head 308. This applied load may cause each pin 300 of each series 310, 320, 330 or some of the pins 300 from each series 310, 320, 330 to at least partially move in a direction toward the resilient member 250, thereby providing a cushioning affect. However, when a lateral or side-to-side movement is made, the angle of the applied load will either be substantially parallel to the longitudinal axis $L_C$ of the posts 313 of the first series of pins 310 or substantially parallel to longitudinal axis $L_C$ of the posts 323 of the second series of pins 320, thereby causing the other of the first series of pins 310 and the second series of pins 320 to provide a banking surface by remaining in the extended state (FIG. 4). During such movements, the third series of pins 330 may be partially moved toward the resilient member 250. For example, if the applied load is substantially parallel to the posts 313 of the first series of pins 310, the pins 300 of the third series of pins 330 located closest to the first series of pins 310 may be moved from the extended state toward the resilient member 250 along with the first series of pins 310 while the pins 300 of the third series of pins 330 located closest to the second series of pins 320 remain in the extended state along with the second series of pins 320, thereby providing a gradient banking surface that increases in a direction from the first series of pins 310 to the second series of pins 320.

In some examples, the posts 313, 323, 333 are substantially the same length. In other examples, the third posts 333 associated with the interior zone 160 of the midsole 220 include a shorter length than the first posts 313 and the second posts 323. In these examples, providing the posts 313, 323 associated with the lateral zone 180 and the medial zone 120 with a longer length may accommodate the angular position of the posts 313, 323 relative to their respective pin heads 308 having the substantially planar engagement surfaces 309.

In some configurations, a corresponding bushing 405 may be disposed within at least one of the series of channels 410, 420, 430. The bushing 405 may be formed from the same or different material as the material of the midsole 220. For example, the bushing 405 may be formed from a harder material than the material of the midsole 220 to provide support for the posts 313, 323, 333. Further, the bushing 405 may be formed form a material that facilitates or restricts movement of the posts 313, 323, 333 relative to the midsole 220. For example, the bushing 405 may be formed from a material that provides an increase in friction between an outer surface of each post 313, 323, 333 and the midsole 220, as the bushings 405 are fixed for movement with the midsole 220. The increased friction allows the bushing 405 to restrict movement of the posts 313, 323, 333 in a direction toward the resilient member 250 when a force is applied in a direction substantially perpendicular to each post 313, 323, 333 to allow the pins 300 to provide and maintain a banking surface during lateral or side-to-side movements.

Referring to FIG. 5, a cross-sectional view taken along line 5-5 of FIG. 3 shows the first series of pins 310 and the second series of pins 320 extending through the heel portion 16 and between the lateral side 18 and the medial side 20 of the midsole 220. The heel portion 16 defines a shorter width extending between the lateral side 18 and the medial side 20 compared to the width at the forefoot portion 12. Accordingly, the heel portion 16 may omit the third series of pins 330 associated with the interior zone 160 of the midsole 220. In some examples, the banking surfaces provided by the first series of pins 310 and the second series of pins 320 located within the heel portion 16 guide the foot so its weight is distributed toward the center of the heel portion 16 and, therefore, reduce the propensity of the foot to roll inward during walking and running movements. Thus, the pins 310, 320 disposed in the heel portion 16 may inhibit or prevent over supination and/or over pronation. In some configurations, the bushing 405 may be disposed within at least one of the series of channels 410, 420, 430.

Figure 6:
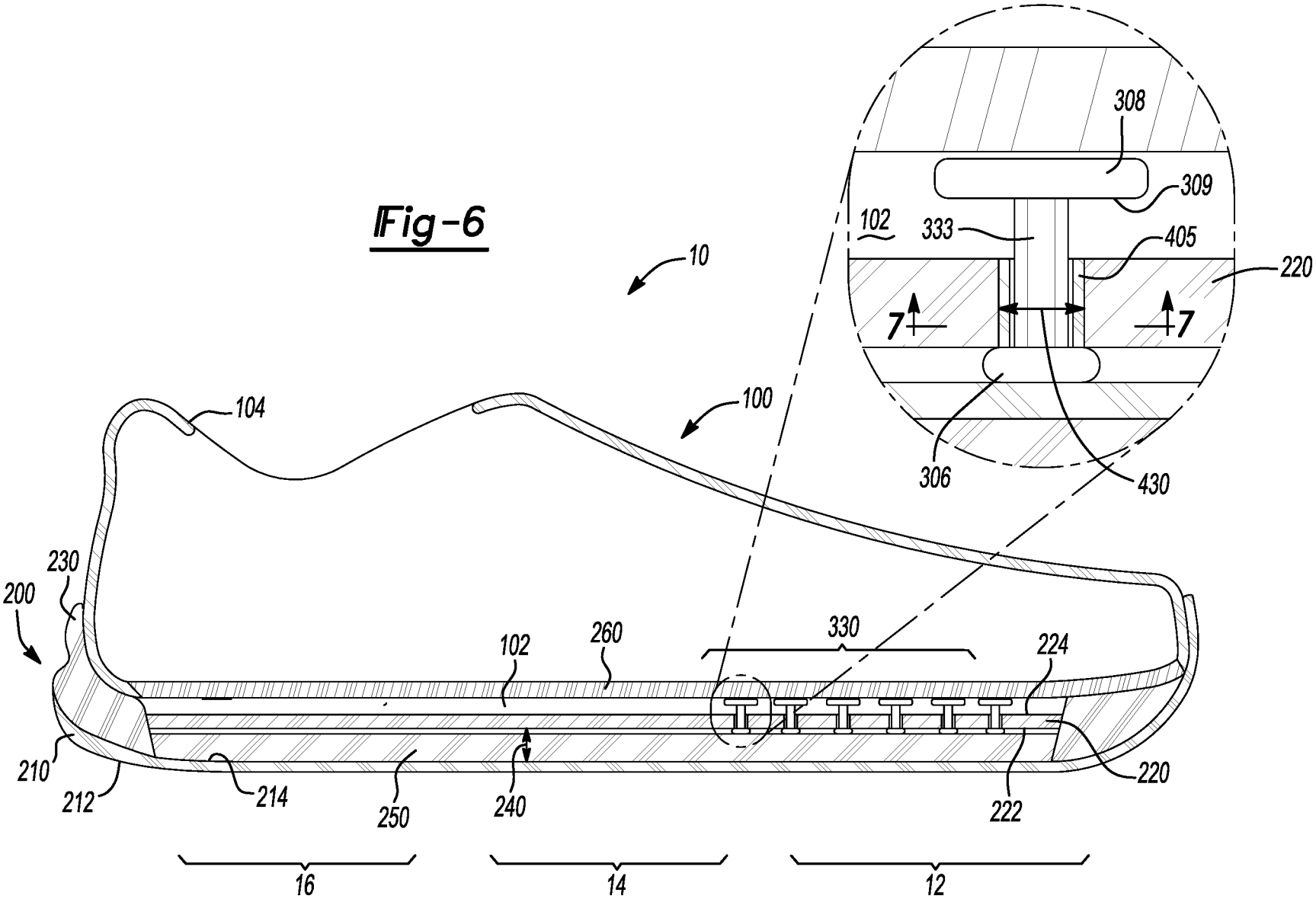
FIG. 6 is a cross-sectional view taken along line 6-6 of FIG. 1 showing three of the series of pins extending through a forefoot portion of the midsole and between lateral and medial sides of the midsole.

Referring to FIG. 6, a cross-sectional view taken along line 6-6 of FIG. 1 shows the third series of pins 330 extending through the midsole 220 and the resilient member 250 disposed between the bottom surface 222 of the midsole 220 and the inner surface 214 of the outsole 210. Specifically, FIG. 6 shows the third series of pins 330 extending along the forefoot portion 12 of the midsole 220. As described above, the resilient member 250 residing within the cavity 240 engages the retention members 306 disposed at the first ends 331 of the pins 330 to bias the pins 330 along the third direction toward the insole 260 located within the interior void 102. The retention members 306 include at least one dimension that is larger than a diameter of the channels 400 and, thus, movement of the pins 330 toward the insole 260 is restricted by engagement between the retention members 306 and the bottom surface 222 of the midsole 220 at a junction of the channels 400 and the bottom surface 222. Note that while FIG. 6 shows a cross-sectional view of the third series of pins 330, similar views could be provided for the first series of pins 320 and the second series of pins 320. However, such cross-sectional views would not show the entirety of each pin 310, 320, as these pins are formed at an angle such that the heads 308 of the respective pins 310, 320 are closer to either the medial side 20 or the lateral side 18 than their respective retention member 306 (FIG. 4). Accordingly, the cross-section of FIG. 6 is taken through the third series of pins 330 so that the pins 330 are fully visible.

FIG. 6 shows a gap separating the engagement surfaces 309 and the footbed 224 when the sole structure 200 is not under load and is at rest. A ground-reaction force applied proximate to the medial side 20 of the midsole 220 may cause the second series of pins 320 to slidably move toward and depress the resilient member 250 so that the resilient member 250 resiliently compresses at the location proximate to the medial side 20 of the footwear 10. As the pins slidably move toward the resilient member 250, the engagement surfaces 309 engage the footbed 224 and the retention members 306 depress the resilient member 250. As the second series of pins 320 slidably move toward and depress the resilient member 250, the third series of pins 330 and the first series of pins 310 (not shown) may remain in the extended states to provide banking surfaces for the footwear 10.

FIG. 6 shows the resilient member 250 including a slab of polymer foam. In some examples, one or more polymer foam materials, such as ethyl-vinyl-acetate or polyurethane, may form the slab of polymer foam to provide responsive and resilient compressibility under an applied load to attenuate ground-reaction forces. Optionally, the resilient member 250 may include a fluid-filled chamber (e.g., bladder; not shown). In some examples, the fluid-filled chamber defines an interior void that receives a pressurized fluid and provides a durable sealed barrier for retaining the pressurized fluid therein. For instance, the pressurized fluid may be air. A wide range of polymer materials may be utilized to form the fluid-filled chamber. In selecting the polymer materials, engineering properties, such as tensile strength, stretch properties, fatigue characteristics, and dynamic modulus, as well as the ability of the materials to prevent the diffusion of the fluid contained by the fluid-filled chamber may be considered. Exemplary materials used to form the fluid-filled chamber may include one or more of thermoplastic urethane, polyurethane, polyester, polyester polyurethane, and polyether polyurethane. The fluid-filled chamber may provide a responsive-type cushioning when under an applied load to attenuate ground-reaction forces.

Figure 7:
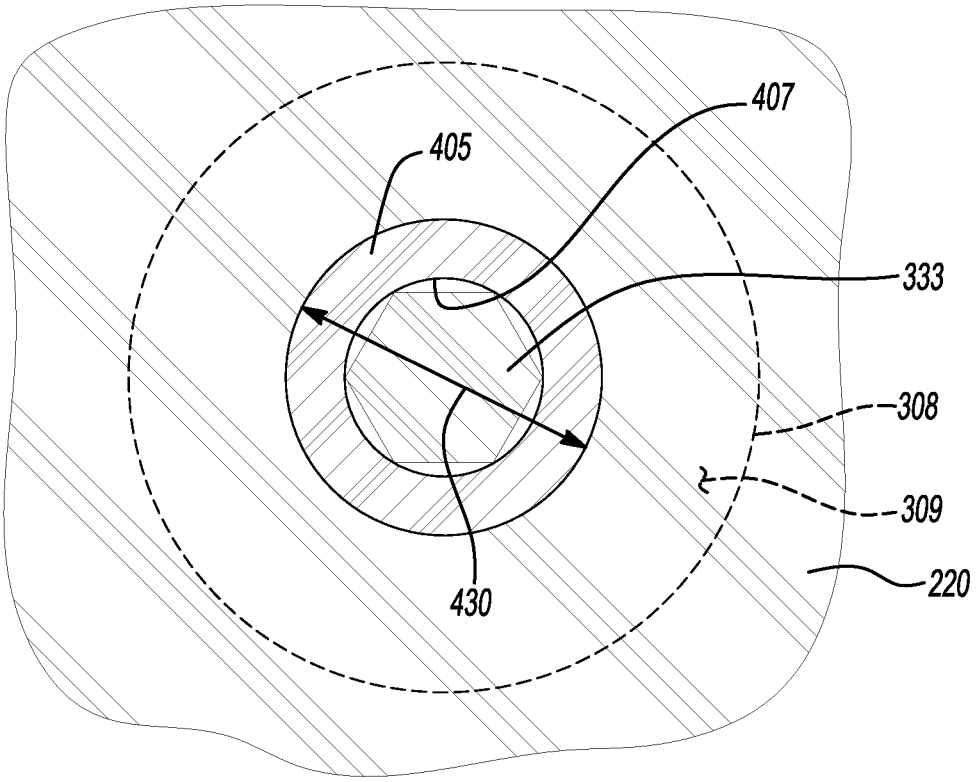
FIG. 7 is a cross-sectional view taken along line 7-7 of FIG. 6 showing one of the series of pins.

In some configurations, the corresponding bushing 405 may be disposed within at least one of the third series of channels 430 (and also at least one of the other channels 420, 430). Referring to FIG. 7, a cross-sectional view taken along line 7-7 of FIG. 6 shows the bushing 405 disposed within a corresponding one of the third series of channels 430 and slidably receiving the third post 333 of the respective one of the third series of pins 330. The bushing 405 may include an inner surface 407 opposing and slidably receiving the third post 333. FIG. 7 also shows the third post 333 having a hexagonal cross-sectional area and the associated pin head 308 having a circular cross-sectional shape. However, the posts 313, 323, 333 and their associated pin heads 308 may each include cross-sectional shapes that may be the same or different.

Referring again to FIGS. 4-7, the posts 313, 323, 333 may include different cross-sectional shapes than the cross-sectional shapes of the respective channels 410, 420, 430 slidably receiving the posts 313, 323, 333 to prevent the posts 313, 323, 333 from rotationally moving within their respective channels 410, 420, 430. In some examples, each of the channels 410, 420, 430 may include the same cross-sectional shape, while in other examples, at least one of the channels 410, 420, 430 may include a different cross-sectional shape than the other channels 410, 420, 430. For example, the channels 410, 420, 430 may include cross-sectional shapes such as, but not limited to, a substantially oval cross-section, a substantially circular cross-section, and a substantially polygonal cross-section. Likewise, the posts 313, 323, 333 may include cross-sectional shapes such as, but not limited to, a substantially oval cross-section, a substantially circular cross-section, and a substantially polygonal cross-section. Any combination of the channels 410, 420, 430 and posts 313, 323, 333 may be incorporated (i.e., round channel with polygonal post, oval channel with oval post, round channel with round post, etc.)

In some examples, at least one of the channels 410, 420, 430 receives the bushing 405 having the corresponding inner surface 407 opposing and slidably receiving its respective post 313, 323, 333. The inner surface 407 may include a higher coefficient of friction than the material of the midsole 220 to prevent unintentional rotation or sliding of its respective post 313, 323, 333. Additionally or alternatively, the bushing 405 may be formed from a harder material than the midsole 220 to protect its associated channel 410, 420, 430 from being stretched or otherwise deformed by the respective posts 313, 323, 333.

In some implementations, the retention members 306 include a size and shape that prevents the retention members 306 from passing through the channels 410, 420, 430 and, therefore, restrict the removal of the pins 310, 320, 330 from their respective channels 410, 420, 430. In some configurations, the pin heads 308 may be positioned so that at least one of the pin heads 308 contacts one or more adjacent pin heads 308 to restrict rotational movement of the pin heads 308. Additionally or alternatively, at least two pins of any one of the series of pins 310, 320, 330 may be attached to one another to restrict rotational movement of the at least two pins.

Referring to FIGS. 8-12, in some implementations, an article of footwear 10*a* is provided and includes an upper 100 and a sole structure 200*a* attached to the upper 100. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The sole structure 200*a* may include an outsole 210*a*, a resilient member 250*a*, and a midsole 220*a* arranged in a layered configuration. The outsole 210*a* includes an inner surface 214*a* disposed on an opposite side of the outsole 210*a* than the ground-engaging surface 212. The midsole 220*a* includes a footbed 224*a* and a bottom surface 222*a* disposed on an opposite side of the midsole 220*a* than the footbed 224*a* and opposing the inner surface 214*a* to define a portion of a cavity 240*a* therebetween. In some examples, the midsole 220*a* is substantially rigid and exhibits characteristics corresponding to a conventional stroble. An insole 260 may be disposed within the interior void 102 under the foot and opposing the footbed 224*a* and the inner surface 214*a*. A remaining portion of the cavity 240*a* may be defined between the insole 260 and the inner surface 214*a*. The sidewall 230 may separate the insole 260 and the inner surface 214*a* to define a depth of the cavity 240*a*. The resilient member 250*a* may be disposed on the inner surface 214 of the outsole 210 and may occupy at least a portion of the depth of the cavity 240*a* to provide a degree of cushioning to the foot during use of the article of footwear 10*a*. The resilient member 250*a* in the article of footwear 10*a* may include a slab of polymer foam. In some examples, one or more polymer foam materials, such as ethyl-vinyl-acetate or polyurethane, may form the slab of polymer foam to provide responsive and resilient compressibility under an applied load to attenuate ground-reaction forces.

Figure 8:
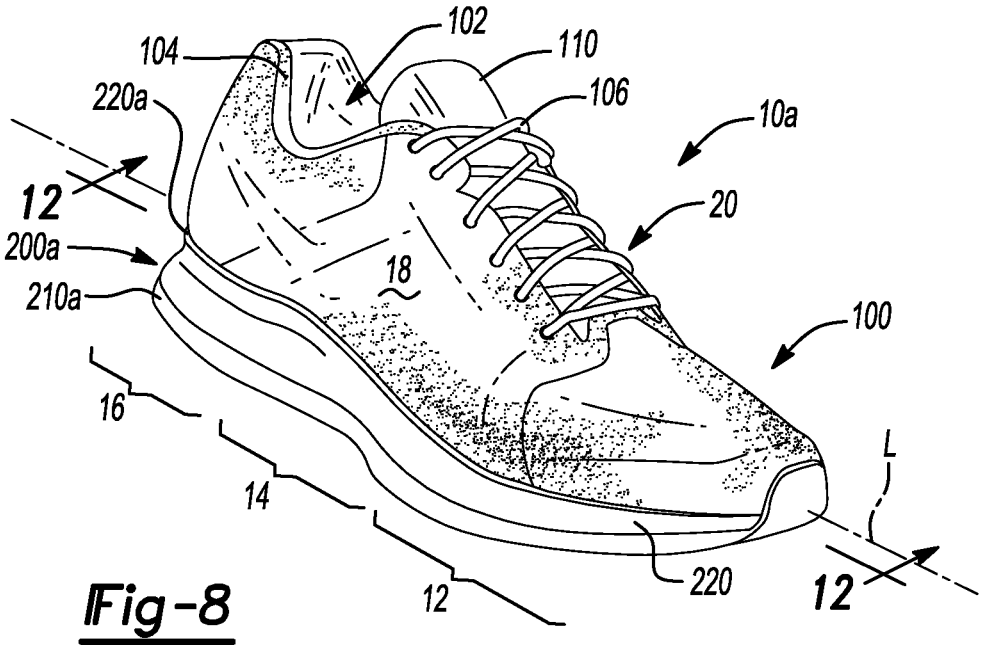
FIG. 8 is a top perspective view of an article of footwear in accordance with principles of the present disclosure.
Figure 9:
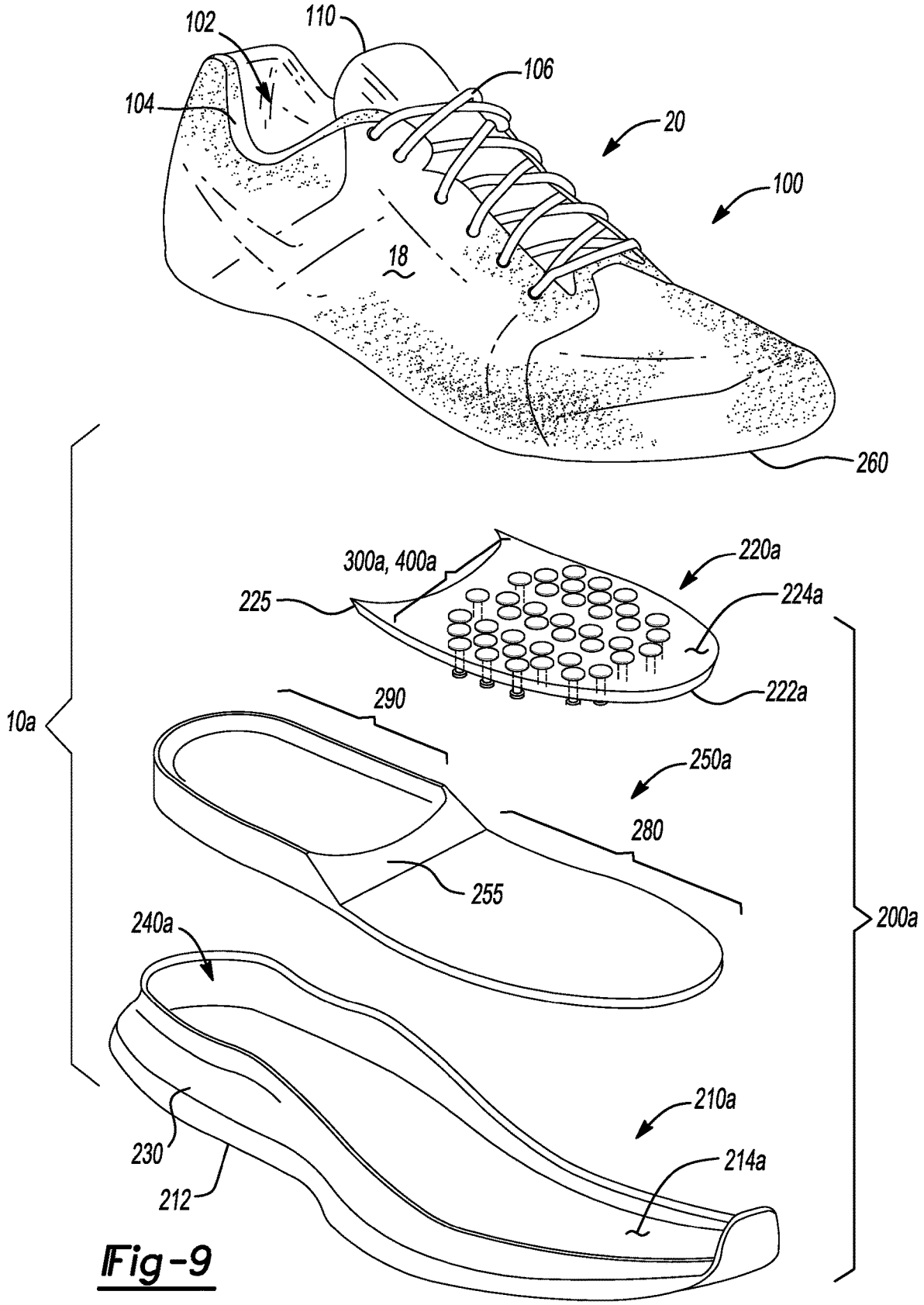
FIG. 9 is an exploded view of the article of footwear of FIG. 8 showing a series of pins extending through a midsole disposed at a forefoot portion of an outsole and a resilient member including a forefoot portion disposed between the midsole and an inner surface of the outsole and a heel portion disposed between an insole and the inner surface of the outsole.

In some implementations, a series of pins 300*a* extend through the midsole 220*a* to support the foot as well as to provide banking surfaces for use of the footwear 10*a* during lateral or side-to-side movements. FIG. 9 is an exploded view of the article of footwear 10*a* of FIG. 8 showing the series of pins 300*a* slidably received by corresponding ones of a series of channels 400*a* extending through the midsole 220*a* disposed at the forefoot portion 12 of the outsole 210*a*. The midsole 220*a* may define a length extending along a longitudinal axis substantially parallel to the longitudinal axis L of the footwear 10*a*. The length of the midsole 220*a* may extend through the forefoot portion 12 of the sole structure 200*a*. The resilient member 250*a* may include a forefoot portion 280 and a heel portion 290.

The forefoot portion 280 of the resilient member 250*a* may be disposed between the bottom surface 222*a* of the midsole 220*a* and the inner surface 214*a* of the outsole 210*a* and may define a length extending through the forefoot portion 12 and a portion of the mid-foot portion 14 of the sole structure 200*a*. The heel portion 290 of the resilient member 250*a* may be disposed between the insole 260 and the inner surface 214*a* of the outsole 210*a* and may define a length extending through the remaining portion of the mid-foot portion 14 and the heel portion 16 of the sole structure 200*a*. In addition to the resilient member 250*a* and the series of pins 300*a* cooperating to enhance functionality, support, and cushioning characteristics of the midsole 220*a*, the resilient member 250*a* and the series of pins 300*a* cooperate to provide banking surfaces to impart stability for the foot during lateral movements when pins 300*a* are in their extended states.

As with the article of footwear of FIGS. 1-7, any banking surface of the article of footwear 10*a* may dynamically retract when pins 300*a* associated with the banking surface are under an axial compressive load. For example, the forefoot portion 280 of the resilient member 250*a* may bias the series of pins 300*a* toward the interior void 102 and at least one of the series of pins 300*a* may transition to its retracted state by slidably moving toward and depressing the forefoot portion 280 of the resilient member 250*a* when an axial compressive load is applied thereto in response to a ground-reaction force. In so doing, the pins 300 resiliently compress the forefoot portion 280 of the resilient member 250*a* to absorb the ground-reaction force. Accordingly, pins 300*a* not under an axial compressive load will remain in their extended states to provide banking surfaces for the foot at locations proximate to the forefoot portion 12 and a portion of the mid-foot portion 14 of the sole structure 200*a* during lateral movements.

Additionally, the heel portion 290 of the resilient member 250*a* may provide increased cushioning for the foot to absorb the initial contact with the ground surface in the heel portion 16 of the sole structure 200*a*. Here, the heel portion 16 of the sole structure 200*a* is associated with heightened loading compared to the mid-foot portion 14 and the forefoot portion 12. Accordingly, the midsole 220*a* may sacrifice dynamic banking surfaces by providing the heel portion 290 of the resilient member 250*a* with an increased thickness that increases the cushioning at locations proximate to the heel portion 16 of the sole structure 200*a* in order to attenuate the heightened loads. In some examples, the resilient member 250*a* includes a slanted surface 255 that aligns or mates with a corresponding slanted surface 225 of the midsole 220*a*. The slanted surfaces 255, 225 may cooperate to align and retain the midsole 220*a* overtop the forefoot portion 280 of the resilient member 250*a*.

Figure 10:
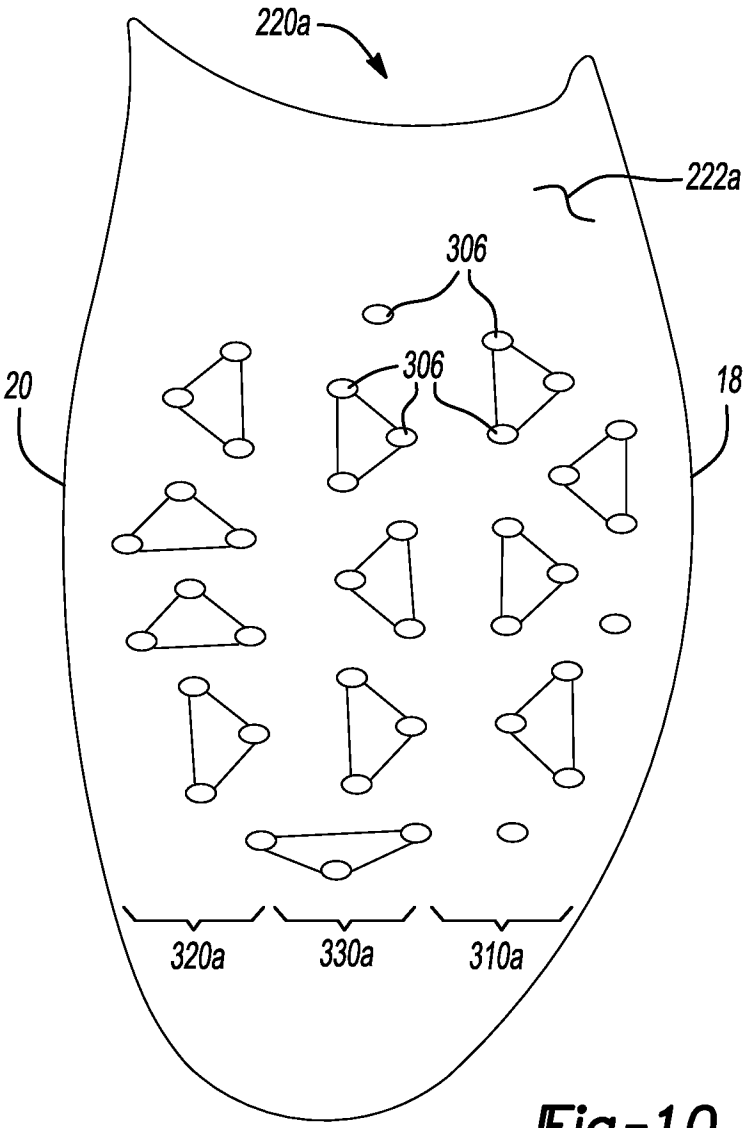
FIG. 10 is a bottom view of the midsole of FIG. 8 showing a series of pins each having a retention member extending through a bottom surface of the midsole.

FIG. 10 is a bottom view of the midsole 220*a* of FIG. 9 showing the series of pins 300*a* collectively including a first series of pins 310*a*, a second series of pins 320*a*, and a third series of pins 330*a* each having their respective retention member 306 extending through the bottom surface 222*a* of the midsole 220*a*. Each series of pins 310*a*, 320*a*, 330*a* may be substantially identical to corresponding ones of the series of pins 310, 320, 330 of the article of footwear 10 of FIGS. 1-7. Accordingly, the series of pins 310*a*, 320*a*, 330*a* may incorporate some or all of the features associated with the corresponding series of pins 310*a*, 320*a*, 330*a*, as described in detail above in FIGS. 1-7 and, therefore, may each be movable between an extended state to provide banking surfaces for use of the footwear 10*a* during lateral movements and a retracted state to depress the resilient member 250*a* for providing resilient compressibility. As discussed above, the retention members 306 may include a size and/or shape that restricts removal of their respective pins 310*a*, 320*a*, 330*a* from the midsole 220*a*.

In some implementations, at least two pins of the first, second, and/or third series of pins 310*a*, 320*a*, 330*a*, respectively, are attached to one another to restrict rotational movement of the at least two pins. FIG. 10 shows groups of three pins attached to one another in each of the series of pins 310*a*, 320*a*, 330*a*. Each group of attached pins may be attached proximate to their respective retention members 306. In other examples, at least one group of the attached pins may be attached proximate to their respective pin heads 308 (FIG. 11).

Figure 11:
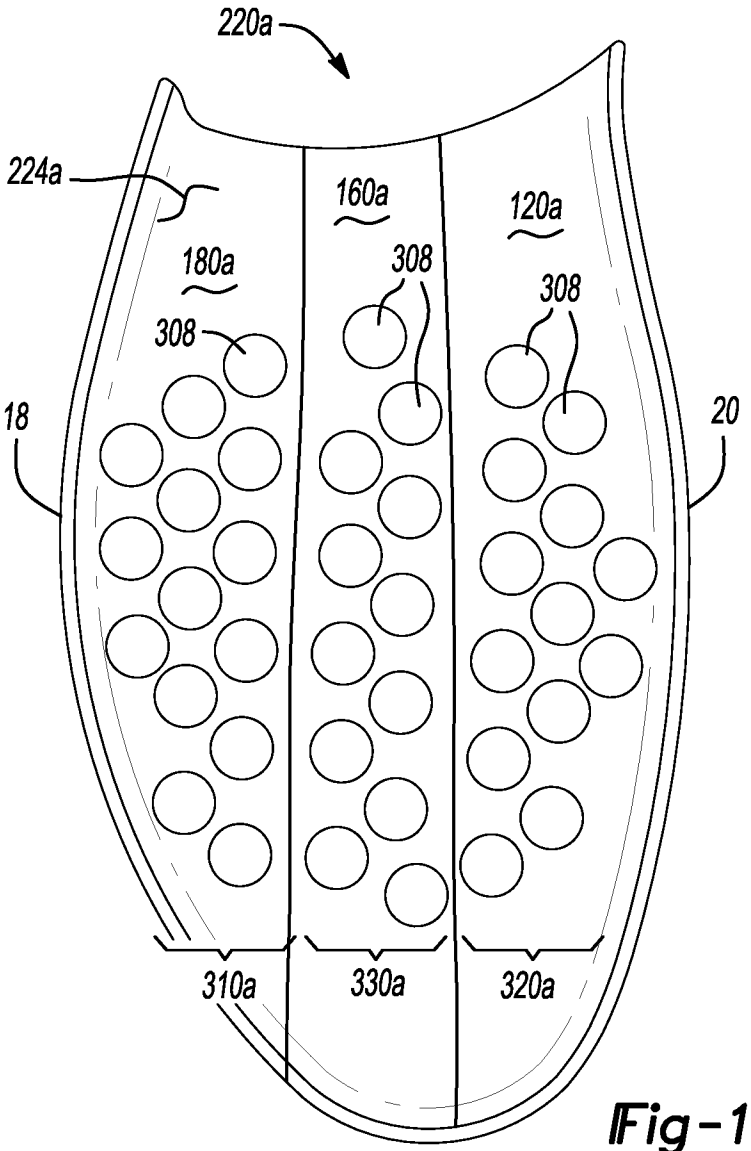
FIG. 11 is a top view of a midsole of FIG. 8 showing a series of pins each having a pin head extending from a footbed of the midsole.

FIG. 11 provides a top view of the midsole 220*a* of FIG. 8 showing the series of pins 310*a*, 320*a*, 330*a* each having their corresponding pin head 308 (and engagement surface 309) extending from the footbed 224*a* of the midsole 220*a*. In some implementations, the midsole 220*a* includes a lateral zone 180*a* located proximate to the lateral side 18 of the footwear 10*a*, a medial zone 120*a* located proximate to the medial side 20 of the footwear 10*a*, and an interior zone 160*a* located between the lateral zone 180*a* and the medial zone 120*a*. In some examples, the first series of pins 310*a* are disposed within the lateral zone 180*a* of the midsole 220*a* and the second series of pins 320*a* are disposed within the medial zone 120*a* of the midsole 220*a*. The third series of pins 330*a* may be disposed within the interior zone 160*a* of the midsole 220*a*.

In some examples, as shown in FIG. 11, the pin heads 308 include a substantially circular cross-section. In other examples, at least one of the pin heads 308 may include a substantially oval cross-section or a substantially polygonal cross-section. In some configurations, the pin heads 308 may be positioned so that at least one of the pin heads 308 contacts one or more adjacent pin heads 308 to restrict rotational movement of the respective pins 310*a*, 320*a*, 330*a*. Similar to the engagement surfaces 309 of the pin heads 308 of the article of footwear 10 of FIGS. 1-7, the engagement surfaces 309 (FIG. 12) of the pin heads 308 of the article of footwear 10*a* may be disposed substantially parallel with the longitudinal axis of the midsole 220.

Figure 12:
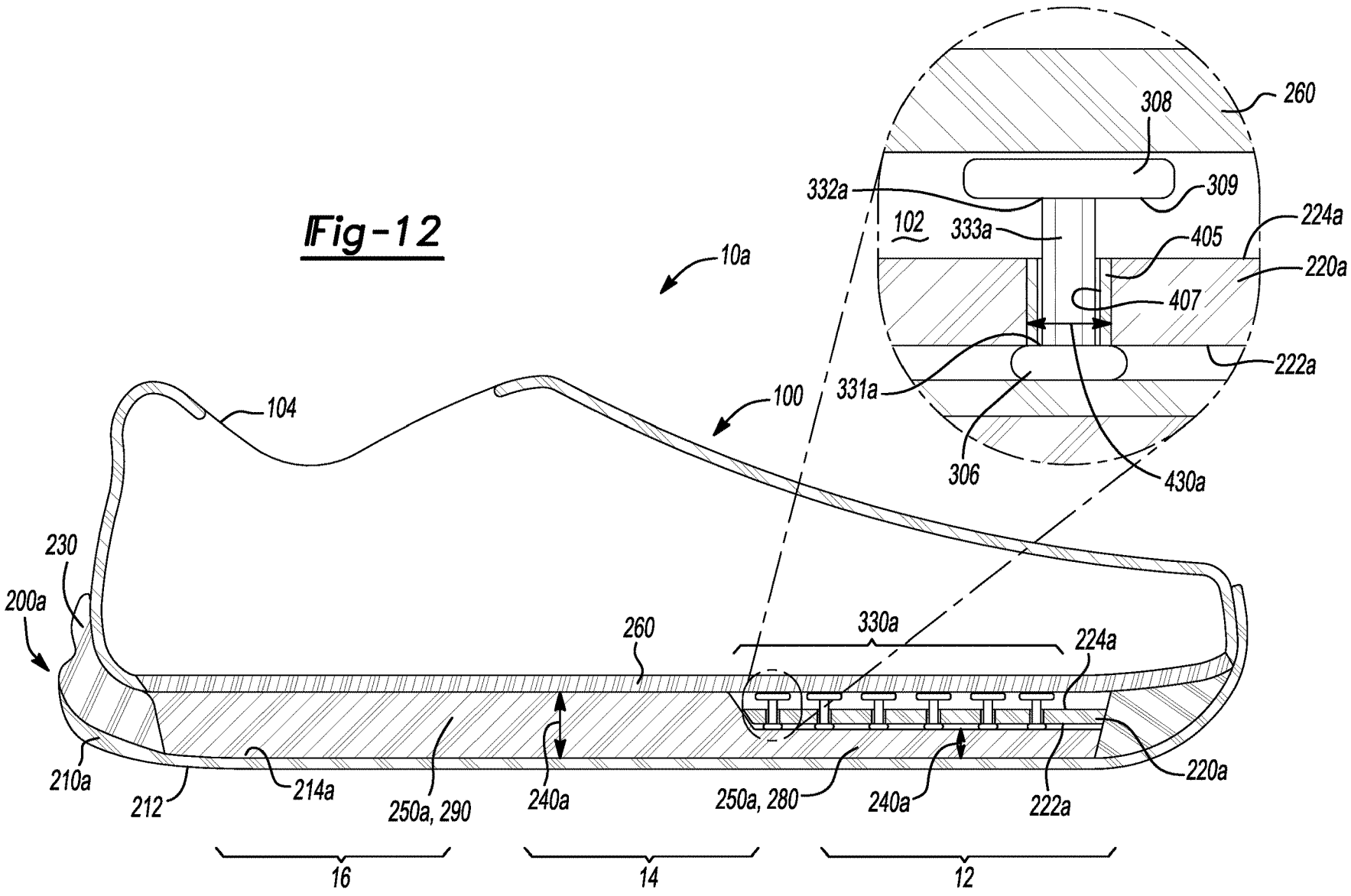
FIG. 12 is a cross-sectional view taken along line 12-12 of FIG. 8 showing a series of pins extending through a midsole disposed at a forefoot portion of an outsole and a resilient member including a forefoot portion disposed between the midsole and an inner surface of the outsole and a heel portion disposed between an insole and the inner surface of the outsole.

Referring to FIG. 12, a cross-sectional view taken along line 12-12 of FIG. 8 shows the third series of pins 330*a* extending through the midsole 220*a* disposed at the forefoot portion 12 of the article of footwear 10. FIG. 12 also shows the resilient member 250*a* including the forefoot portion 280 disposed between the midsole 220*a* and the inner surface 214*a* of the outsole 210*a* and the heel portion 290 disposed between the insole 260 and the inner surface 214*a* of the outsole 210*a*. The third series of pins 330*a* may be slidably received by corresponding ones of a third series of channels 430*a* extending through the midsole 220*a*. While not shown in FIG. 12, the first series of pins 310*a* may be slidably received by corresponding ones of a first series of channels (e.g., similar to the first series of channels 410 of FIGS. 4-7) and the second series of pins 320*a* may be slidably received by corresponding ones of a second series of channels (e.g., similar to the second series of channels 420 of FIGS. 4-7). At least of the channels may slidably receive the bushing 405 and associated inner surface 407, as described above with reference to the article of footwear 10 of FIGS. 1-7. The forefoot portion 280 of the resilient member 250*a* engages the retention members 306 of the third series of pins 330*a* to bias the pins along the third direction toward the insole 260 located within the interior void 102.

While not shown in FIG. 12, the forefoot portion 280 of the resilient member 250*a* engages the retention members 306 of the first series of pins 310*a* and the retention members 306 of the second series of pins 320*a* to bias the pins along their respective first and second directions toward the insole 260. As with the first and second series of pins 310, 320 of FIG. 4, the first and second series of pins 310*a*, 320*a* are formed an angle such that the head 308 of the first series of pins 310*a* are disposed closer to the lateral side 18 than their retention members 306 and the heads 308 of the second series of pins 320*a* are disposed closer to the medial side 20 than their retention members 306.

FIG. 12 shows a gap separating the engagement surfaces 309 and the footbed 224*a* while the sole structure 200*a* is not under load and is at rest. A ground-reaction force applied proximate to the interior zone 160*a* of the midsole 220*a*, however, may cause the third series of pins 330*a* to transition to their retracted state by slidably moving toward and depressing the forefoot portion 280 of the resilient member 250*a* so that the resilient member 250*a* resiliently compresses in the interior zone 160*a* of the footwear 10*a*. As the pins slidably move toward the forefoot portion 280 of the resilient member 250*a*, the engagement surfaces 309 engage the footbed 224*a* and the retention members 306 depress the resilient member 250*a*. In doing so, the pins of the first series 310 and the second series 320 may be in their extended states to provide banking surfaces for the foot during lateral movements that transition toward the lateral side 18 or the medial side 20 of the midsole 220*a* from the interior zone 160*a* of the midsole 220*a* depending on the direction of the applied load.

The pins 310*a*, 320*a*, 330*a* may move relative to one another depending upon whether or not axial compressive loads are applied thereto. Further, during forward walking or running events, the first series of pins 310*a* and the second series of pins 320*a* may likewise at least partially move towards and engage the resilient member 250*a*. For example, and as described above with respect to the first series of pins 310 and the second series of pins 320, the pin heads 308 are substantially parallel to the footbed 22*a* even though the respective posts 313, 323 are formed at an angle. Accordingly, when a force is applied to the pin heads 308 that is substantially perpendicular to the surface of the pin heads 308 (i.e., during a forward walking or running movement), the pins of the first and second series of pins 310*a*, 320*a* may move towards and compress the resilient member 250*a*. When such movement transitions from a forward movement to a lateral movement, one of the series of pins 310*a*, 320*a* moves fully toward the resilient member 250*a* while the other of the series of pins 310*a*, 320*a* remains in the extended state to provide a banking surface in a similar fashion as described above with respect to the first series of pins 310 and the second series of pins 320.

The heel portion 16 of the sole structure 200*a*, however, omits the midsole 220*a* and the series of pins 310*a*, 320*a* 330*a* extending therethrough, and is instead provided with the heel portion 290 of the resilient member 250*a* to provide increased cushioning for accommodating heightened ground-reaction forces directed toward the heel portion 16 of the sole structure 200*a*. Thus, the heel portion 290 of the resilient member 250*a* attenuates loads occurring from initial contact of the heel portion 16 striking the ground surface, while the forefoot portion 12 of the sole structure 200*a* utilizes banking surfaces provided by the forefoot portion 280 of the resilient member 250*a* in communication with the pins 300*a* extending through the midsole 220*a* to impart stability and, thus, enhance performance of the footwear 10*a* during lateral movements. The forefoot portion 280 of the resilient member 250*a* also provides a degree of cushioning to attenuate ground-reaction forces when depressed by corresponding pins 310*a*, 320*a*, 330*a* when moved into their retracted states (i.e., toward the resilient member 250*a*).

Referring to FIGS. 13-15, in some implementations, an article of footwear 10*b* is provided and includes an upper 100 and a sole structure 200*b* attached to the upper 100. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

The sole structure 200*b* may include an outsole 210*b*, a slab of polymer foam 250*b*, a fluid-filled chamber 1250, a first midsole 220*b*, and a second midsole 1220. The outsole 210*b* includes an inner surface 214*b* disposed on an opposite side of the outsole 210*b* than the ground-engaging surface 212. An insole 260 may be disposed within the interior void 102 under the foot and opposing the first midsole 220*b* and the second midsole 1220. A cavity 240*b* may be defined between the midsoles 220*b*, 1220 and the inner surface 214*b* of the outsole 210*b*. The sidewall 230 may separate the midsoles 220*b*, 1220 and the inner surface 214*b* to define a depth of the cavity 240*b*. The slab of polymer foam 250*b* may be disposed on the inner surface 214*b* of the outsole 210*b* and may define a length extending along the longitudinal axis L and through the forefoot portion 12 and the mid-foot portion 14 of the sole structure 200*b*.

The fluid-filled chamber 1250 may be disposed on the inner surface 214*b* adjacent to the slab of polymer foam 250*b* and may define a length extending through the heel portion 16 of the sole structure 200*b*. A divider 216 may extend into the cavity 240*a* from the inner surface 214*b* of the outsole 210*b* in a direction substantially perpendicular to the longitudinal axis L of the sole structure 200*b*. For instance, the slab of polymer foam 250*b* and the fluid-filled chamber 1250 may be disposed on the inner surface 214*b* on opposite sides of the divider 216. The divider 216 may retain the foam 250*b* and the chamber 1250 from shifting longitudinally, while the inner periphery of the sidewall 130 bounds the foam 250*b* and the chamber 1250 between the lateral side 18 and the medial side 20. The slab of polymer foam 250*b* and the fluid-filled chamber 1250 may occupy a portion of the depth of the cavity 240*b* to provide a degree of cushioning to the foot during use of the article of footwear 10*b*. In some examples, the divider 216 is integrally formed with and projects from the outsole 210*b* at the inner surface 214*b*.

The first midsole 220*b* includes a bottom surface 222*b* opposing the slab of polymer foam 250*b* and a footbed 224*b* disposed on an opposite side of the first midsole 220*b* than the bottom surface 222*b* and opposing the insole 260. The second midsole 1220 includes a bottom surface 1222 opposing the fluid-filled chamber 1250 and a footbed 1224 disposed on an opposite side of the second midsole 1220 than the bottom surface 1222 and opposing the insole 260. In some examples, the midsoles 220*b*, 1220 are substantially rigid and exhibit characteristics corresponding to a conventional stroble.

In some implementations, a series of pins 300*b* extend through the first midsole 220*b* and the second midsole 1220 to support the foot as well as to provide banking surfaces for use of the footwear 10*b* during forward and lateral movements. The pins 300*b* may be slidably received by corresponding ones of a series of channels 400*b* extending through the first midsole 220*b* and the second midsole 1220. FIG. 14 is an exploded view of the article of footwear 10*b* of FIG. 13 showing the series of pins 300*b* extending through the first midsole 220*b* disposed at the forefoot portion 12 of the outsole 210*b* and also extending through the second midsole 1220 disposed at the heel portion 12 of the outsole 210*b*.

The series of pins 300*b* extending through the first midsole 220*b* may collectively include a first series of pins 310*b*, a second series of pins 320*b*, and a third series of pins 330*b*.

The series of pins 300*b* extending through the second midsole 1220 may collectively include the first series of pins 310*b* and the second series of pins 320*b*. In some implementations, the midsoles 220*b*, 1220 includes a lateral zone 180*b* located proximate to the lateral side 18 of the footwear 10*b* and a medial zone 120*b* located proximate to the medial side 20 of the footwear 10*b*. Optionally, the first midsole 220*b* may include a toe-off zone 190 located proximate to the tip of the sole structure 200*b* (e.g., tip of the forefoot portion 12) where the toes of the foot reside. In some examples, the first series of pins 310*b* are disposed within the lateral zone 180*b* of the midsoles 220*b*, 1220, while the second series of pins 320*b* are disposed within the medial zone 120*b* of the midsoles 220*b*, 1220. The first series of pins 310*b* and the second series of pins 320*b* are substantially identical to corresponding ones of the first series of pins 310 and the second series of pins 320 described above with reference to the article of footwear 10 of FIGS. 1-7. Accordingly, the series of pins 310*b*, 320*b* may incorporate some or all of the features associated with the corresponding series of pins 310, 320, as described in detail above with respect to FIGS. 1-7. Therefore, the first series of pins 310*b* and the second series of pins 320*b* may each be movable between an extended state to provide banking surfaces for use of the footwear 10*a* during lateral movements and a retracted state to provide resilient compressibility for attenuating ground-reaction forces.

The third series of pins 330*b* located within the toe-off zone 190, however, may provide a banking surface for the toes of the foot and energy return when the toes push off of the ground surface to propel the article of footwear 10*b* forward during walking or running movements. The third series of pins 330*b* are described in greater detail below with reference to FIG. 15.

With continued reference to FIG. 14, the series of pins 310*b*, 320*b*, 330*b* may each have a corresponding pin head 308 extending from the footbed 224*b* of the first midsole 220*b*. Likewise, the corresponding pin heads 308 of the first series of pins 310*b* and the second series of pins 320*b* may extend from the footbed 1224 of the second midsole 1220. Each pin head 308 is associated with the corresponding engagement surface 309 (FIG. 15) that opposes at least one of the footbeds 224*b*, 1224 of the midsoles 220*b*, 1220. The example of FIG. 14 shows the first midsole 220*b* associated with pin heads 308 having substantially hexagonal cross-sections and the second midsole 1220 associated with pin heads 308 having substantially oval cross-sections. Pin heads 308 having hexagonal (or other polygonal shape) cross-sections or oval cross-sections may restrict rotation of the associated pins 310*b*, 320*b*, 330*b* by providing edges that are susceptible to engaging with adjacent pin heads 308.

Conversely, pin heads 308 having substantially circular cross-sections may be less likely to engage with adjacent pin heads 308 during slight rotational movements by the associated pins 310*b*, 320*b*, 330*b*. In other examples, the pin heads 308 may include any combination of substantially circular, substantially oval, or substantially polygonal cross-sections to restrict the respective pins 310*b*, 320*b*, 330*b* from rotating relative to the midsoles 220*b*, 1220. In some configurations, the pin heads 308 may be positioned so that at least one of the pin heads 308 contacts one or more adjacent pin heads 308 to restrict rotational movement of the respective pins 310*b*, 320*b*, 330*b*. Additionally or alternatively, the posts 313, 323, 333 may include a cross-sectional shape that restricts rotation of the pins 10*b*, 320*b*, 333*b* relative to the midsoles 220*b*, 1220. For example, the posts 313, 323, 333 may include an oval cross-section that is received by an oval cross section of the bushing 405 or the channels 400 such that relative rotation of the pins 310*b*, 320*b*, 330*b* and the midsoles 220*b*, 1220 is prevented while concurrently allowing the pins 310*b*, 320*b*, 330*b* to translate therein.

As with the engagement surfaces 309 of the article of footwear 10 of FIGS. 1-7, the pins 310*b*, 320*b*, 330*b* of the footwear 10*b* may include engagement surfaces 309 (FIG. 15) disposed substantially parallel with the longitudinal axis of the midsole 220*b*. FIG. 14 also shows the series of pins 310*b*, 320*b*, 330*b* each having corresponding retention members 306 sized and shaped to prevent removal of the respective pins 310*b*, 320*b*, 330*b*, from the midsoles 220*b*, 1220.

The fluid-filled chamber 1250 may function as a resilient member to cooperate with the first series of pins 310*b* and the second series of pins 320*b* extending through the second midsole 1220 to enhance functionality, support, and cushioning characteristics that a conventional midsole provides. Additionally, the pins 310*b*, 320*b* and the fluid-filled chamber 1250 may cooperate to provide banking surfaces to impart stability for the foot during lateral movements when the pins 310*b*, 320*b* are in their extracted states. As with the footwear 10 of FIGS. 1-7, any banking surface of the footwear 10*b* may dynamically retract when pins 310*b*, 320*b* associated with the banking surface are under an axial compressive load. For example, the fluid-filled chamber 1250 may bias the series of pins 310*b*, 320*b* along their respective first or second direction toward the interior void 102, thereby allowing the pins 310*b*, 320*b* to be in their extended states. However, at least one of the series of pins 310*b*, 320*b* may transition to its retracted state by slidably moving along its respective first or second direction toward and depressing the fluid-filled chamber 1250 when an axial compressive load is applied thereto in response to a ground-reaction force. As such, the pins 310*b*, 230*b* resiliently compress the fluid-filled chamber 1250 to absorb the ground-reaction force. Accordingly, pins 310*b*, 320*b* not under an axial compressive load will remain in their extended states to provide banking surfaces for the foot at locations proximate to the lateral side 18 and the medial side 20 of heel portion 16 of the sole structure 200*b* during lateral movements depending on the direction of the lateral movement. Additionally, the banking surfaces provided by the pins 310*b*, 320*b* may assist in centering the heel of the foot within the center of the heel portion 16 of the sole structure 200*b* so that inward and/or outward rolling is prevented and, thus, a foot having a tendency to over supinate or over pronate may be inhibited and/or corrected.

As with the fluid-filled chamber 1250, the slab of polymer foam 250*b* may cooperate with the series of pins 310*b*, 320*b*, 330*b* extending through the first midsole 220*b* to enhance functionality, support, and cushioning characteristics that a conventional midsole provides. Additionally, the pins 310*b*, 320*b* and the slab of polymer foam 250*b* may cooperate to provide banking surfaces to impart stability for the foot during lateral movements when the pins 310*b*, 320*b* are in their extended states. As with the footwear 10 of FIGS. 1-7, any banking surface of the footwear 10*b* may dynamically retract when the pins 310*b*, 320*b* associated with the banking surface are under an axial compressive load. For example, the slab of polymer foam 250*b* may bias the first series of pins 310*b* and the second series of pins 320*b* along their respective first and second directions toward the interior void 102, thereby allowing the pins 310*b*, 320*b* to be in their extended states. However, at least one of the series of pins 310*b*, 320*b* may transition to its retracted state by slidably moving along its respective first or second direction toward the slab of polymer foam 250*b* when an axial compressive load is applied to the at thereto in response to a ground-reaction force. Movement of the pins 310*b*, 320*b* toward the foam 250*b* resiliently compresses the slab of polymer foam 250*b* to absorb the ground-reaction force. Accordingly, the pins 310*b*, 320*b* not under an axial compressive load will remain in their extended states to provide banking surfaces for the foot at locations proximate to the lateral side 18 and the medial sides 20 of the forefoot portion 12 and the mid-foot portion 14 of the sole structure 200*b* during lateral movements.

Additionally, and described in greater detail below with reference to FIG. 15, the slab of polymer foam 250*b* may bias the third series of pins 330*b* along a respective third direction toward the interior void 102, thereby permitting the pins 330*b* to be in an extended state. Axial compressive loads applied to the pins 330*b*, however, may transition the pins 330*b* to a retracted state by slidably moving along their respective third direction toward and depressing the slab of foam 250 in response to the toes of the foot contacting the ground surface. In so doing, the pins 330*b* resiliently compress the slab of polymer foam 250*b* and provide energy return to aid a user in propelling the article of footwear 10*b* forward.

Referring to FIG. 15, a cross-sectional view taken along line 15-15 of FIG. 13 shows the second series of pins 320*a* and the third series of pins 330*b* extending through the first midsole 220*b* disposed to the right of the divider 216 and the second series of pins 320*b* extending through the second midsole 1220 disposed to the left of the divider 216. The slab of polymer foam 250*b* is disposed between the first midsole 220*b* and the inner surface 214*b* of the outsole 210*b* and the fluid-filled chamber 1250 is disposed between the second midsole 1220 and the inner surface 214*b* of the outsole 210*b*. The slab of polymer foam 250*b* and the fluid-filled chamber 1250 may provide different cushioning characteristics.

In other configurations, the chamber 1250 and the foam 250*b* may be switched to opposite sides of the divider 216. Optionally, any combination of the fluid-filled chamber 1250 and the slab of polymer foam 250*b* may be disposed between the midsoles 220*b*, 1220 and the inner surface 214*b* of the outsole 210*b*. Namely, polymer foam 250*b* may be disposed between both of the midsoles 220*b*, 1220 and the inner surface 214*b* of the outsole 210*b* or fluid-filled chambers 1250 may be disposed between both of the midsoles 220*b*, 1220 and the inner surface 214*b* of the outsole 210*b*. The slab of polymer foam 250*b* may be formed from one or more polymer foam materials, such as ethyl-vinyl-acetate or polyurethane, to provide responsive and resilient compressibility under an applied load to attenuate ground-reaction forces.

The fluid-filled chamber 1250 may include a barrier 1260 and a tensile member 1270. The barrier 1260 forms an exterior of the chamber 1250 that defines an interior void 1252 that receives both a pressurized fluid (e.g., air) and the tensile member 1270. The barrier 1260 provides a durable sealed barrier for retaining the pressurized fluid within the chamber 1250. A wide range of polymer materials may be utilized to form the barrier 1260. In selecting the polymer materials, engineering properties, such as tensile strength, stretch properties, fatigue characteristics, and dynamic modulus, as well as the ability of the materials to prevent the diffusion of the fluid contained by the chamber 1250 may be considered. Exemplary materials used to form the fluid-filled chamber 1250 may include one or more of thermoplastic urethane, polyurethane, polyester, polyester polyurethane, and polyether polyurethane.

The barrier 1260 may include an upper barrier portion 1261 opposing the cavity 240*b* and a lower barrier portion 1262 opposing the inner surface 214*b* of the outsole 210*b*. A peripheral edge 1263 of the barrier 1260 may extend around a periphery of the chamber 1250 between the upper barrier portion 1261 and the lower barrier portion 1262. The tensile member 1270 is located within the interior void 1252 and may include textile elements and/or tether elements. In some implementations, the tensile member 1270 may be formed from, or be formed to include, a foam tensile member. The tensile member 1270 may include an upper tensile layer 1271 secured to an inner surface of the upper barrier portion 1261 and a lower tensile layer 1272 secured to an inner surface of the lower barrier portion 1262. Thus, the tensile member 1270 is secured to each of the barrier portions 1261, 1262 to retain an intended shape of the chamber 1250 once inflated. More particularly, connecting members 1273 extending across the interior void 1252 are placed in tension by the outward force of the pressurized fluid acting on the barrier 1260, thereby preventing the barrier 1260 from expanding outward and, thus, allowing the chamber 1250 to retain its intended shape. The connecting members 1273 may include yarns, fibers, or filaments formed from a variety of materials, and may be positioned across a length and width of the tensile member 1270 at a relatively sparse density, a relatively packed density, or any other density. The tensile member 1270 may additionally include gaps at which the barrier portions 1261, 1262 are bonded together.

In some implementations, each of the third series of pins 330*b* have a third post 333*b* extending through corresponding ones of a third series of channels 430*b* in a third direction substantially parallel to a longitudinal axis $L_C$ of the third post 333*b*. The third series of channels 430*b* may be positioned in the toe-off zone 190 of the first midsole 220*b* and may extend through the footbed 224*b* and the bottom surface 222*b*. The third posts 333*b* may extend between a first end 331*b* and a second end 332*b*. The first end 331*b* extends into the cavity 240*b* outward from the bottom surface 222*b*. The corresponding pin head 308 of each pin 300*b* of the third series of pins 330*b* is disposed at the second end 332*b* and the corresponding retention member 306 is disposed at the first end 331*b*. At least one channel of the third series of channels 430*b* may slidably receive the bushing 405 and associated inner surface 407, as described above with reference to the article of footwear 10 of FIGS. 1-7.

In some configurations, the second ends 332*b* (e.g., pin heads 308) of the third series of pins 330*b* are disposed farther from the tip of the sole structure 200*b* where the toes of the foot reside than their respective first ends 331*b* (e.g., retention members 306). Each of the third posts 333*b* may slidably move through their respective third channel 430*b* relative to the first midsole 220*b* during normal forward walking or running events, as a force is applied along the longitudinal axis $L_C$ of the pins 330*b* and/or in a direction substantially perpendicular or normal to the pin heads 308 of the third series of pins 330*b* as the foot moves from heel to toe. The slab of polymer foam 250*b* may engage the first ends 331*b* (e.g., retention members 306), thereby biasing each of the pins 330*b* along their associated third direction toward the insole 260 and into an extended state. Thus, the third series of pins 330*b*, while in their extended state, provide a banking surface for the toes of the foot. This banking surface may be used during launching conditions (i.e., at the start of a race or run) when a toe applies a force on the pins 330*b* in a direction substantially perpendicular to the posts 333*b*. This banking surface may be used to help the user launch from rest and may be subsequently used during running movements as a surface against which the toes may react. Conversely, when an axial compressive load is applied to the pins 330*b* in response to a load applied by the toes as the foot rolls from the heel to the toes (i.e., during a heel-strike movement), the pins 330*b* slidably move along their associated third direction toward the slab of polymer foam 250*b* into their retracted states, thereby causing the slab of polymer foam 250*b* to resiliently compress and provide energy return to aid the user in propelling the article footwear 10*b* forward during walking or running movements. In other words, the energy return provided by the compressed slab of polymer foam 250*b* corresponds to a spring-effect to enhance the rate at which the article of footwear 10*b* propels forward.

The engagement surfaces 309 of all the pin heads 308 of the third series of pins 330*b* may be disposed substantially parallel to the longitudinal axis L of the first midsole 220*b*. Thus, the longitudinal axis $L_C$ of the third posts 333*b* is angled relative to the longitudinal axis L of the first midsole 220*b* (e.g., slopes away from the tip of the sole structure 200*b* from the first end 331*b* to the second end 332*b*). By forming the third posts 333*b* of the third series of pins 330*b* at an angle relative to the respective pin heads 308, the pins 330*b* may be restricted from moving relative to the first midsole 220*b* unless a force by the toes pushing against the ground surface (e.g., axial compressive load) is applied along the third direction substantially parallel to the longitudinal axis $L_C$ of each third post 333*b* and/or is applied substantially perpendicular or normal to the pin heads 308.

In some implementations, the second series of pins 320*b* are slidably received by corresponding ones of a second series of channels 420*b* extending through each of the midsoles 220*b*, 1220. While not shown in FIG. 15, the first series of pins 310*b* may be slidably received by corresponding ones of a first series of channels (e.g., similar to the first series of channels 410 of FIGS. 4-7). At least one channel may slidably receive the bushing 405 and associated inner surface 407, as described above with reference to the article of footwear 10 of FIGS. 1-7.

The slab of polymer foam 250*b* engages the retention members 306 of the first series of pins 310*b* and the second series of pins 320*b* associated with the first midsole 220*b* to bias the pins along their respective first and second directions toward the insole 260*b* located within the interior void. A ground-reaction force applied proximate to the medial side 20 of the first midsole 220*a*, however, may cause the second series of pins 320*b* to transition to their retracted states by slidably moving toward and depressing the slab of polymer foam 250*b* so that the slab of polymer foam 250*b* resiliently compresses at the location proximate to the medial side 20 of the footwear 10*b*. As the pins slidably move toward the slab of polymer foam 250*b*, the engagement surfaces 309 engage the footbed 224*b* and the retention members 306 depress the slab of polymer foam 250*b*. In doing so, the first series of pins 310*b* may be in their extended states to provide banking surfaces for the foot during lateral movements from the medial side 20 of the footwear 10*b*.

Similarly, the fluid-filled chamber 1250 engages the retention members 306 of the first series of pins 310*b* (not shown in FIG. 15) and the second series of pins 320*b* associated with the second midsole 1220 to bias the pins along their respective first and second directions toward the insole 260*b* located within the interior void 102. A ground-reaction force applied proximate to the lateral side 18 of the second midsole 1220, however, may cause the second series of pins 320*b* to transition to their retracted states by slidably moving toward and depressing the fluid-filled chamber 1250 so that the fluid-filled chamber 1250 resiliently compresses at the location proximate to the lateral side 18 of the footwear 10*b*. As the pins slidably move toward the fluid-filled chamber 1250, the engagement surfaces 309 engage the footbed 1224 and the retention members 306 depress the fluid-filled chamber 1250. In doing so, the first series of pins 310*b* may be in their extended states to provide banking surfaces for the foot during lateral movements from the lateral side 18 of the footwear 10*b*. Additionally, the third series of pins 330*b* may be in their extended states to provide a banking surface for the toes of the foot when the toes push off of the ground surface to propel the article of footwear 10*b* forward during walking or running movements, as discussed above. The pins 310*b*, 320*b* associated with the second midsole 1220 may slidably and independently move relative to the pins 310*b*, 320*b*, 330*b* associated with the first midsole 220*b*.

Referring to FIGS. 16-18, in some implementations, an article of footwear 10*c* is provided and includes an upper 100 and a sole structure 200*c* attached to the upper 100. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

The sole structure 200*c* may include an outsole 210*c*, a biasing member 250*c*, and the midsole 220 of the article of footwear 10 of FIGS. 1-7 arranged in a layered configuration. The outsole 210*c* includes an inner surface 214*c* disposed on an opposite side of the outsole 210*c* than the ground-engaging surface 212. The insole 260 may be disposed within the interior void 102 under the foot and may oppose the footbed 224 and the inner surface 214*c*. A cavity 240*c* may be defined between the bottom surface 222 of the midsole 220 and the inner surface 214*c*. The sidewall 230 may separate the midsole 220 and the inner surface 214*c* to define a depth of the cavity 240*c*. In contrast to the article of footwear 10 of the examples of FIGS. 1-7, the resilient member 250 including a slab of polymer foam (or a fluid-filled bladder in the alternative) is removed. Instead, the biasing member 250*c* is disposed on the inner surface 214*c* of the outsole 210*c* and occupies at least a portion of the depth of the cavity 240*c* to attenuate ground-reaction forces during use of the article of footwear 10*c*.

In some implementations, the biasing member 250*c* in the article of footwear 10*c* may include a plate 1600 supported by at least one spring 1602 or coil extending from the inner surface 214*c* of the outsole 210*c*. In other implementations, a support base (not shown) may reside on the inner surface 214*b* and the at least one spring 1602 or coil may extend from the second plate and support the plate 1600. As with the resilient member 250 of the examples of FIGS. 1-7, the basing member 250*c* of the article of footwear 10*c* may engage the first end of each pin 300 to bias the series of pins 300 in the first direction toward the insole 260 within the interior void 102. FIGS. 17 and 18 are partial cross-sectional views of the forefoot portion 12 of the sole structure 200*c* taken along line 17-17 of FIG. 16 showing the third series of pins 330 extending through the midsole 220 and the biasing member 250*c* disposed between the bottom surface 222 of the midsole 220 and the inner surface 214*c* of the outsole 210*c*. The first end 331 of each pin 300 may extend into the cavity 240*c* outward from the bottom surface 222 of the midsole 220 and the second end 332 of each pin 300 may extend into the interior void 102 outward from the footbed 224 of the midsole 220. The posts 333 of the third series of pins 330 may be slidably received by the third series of channels 430.

More specifically, FIGS. 17 and 18 show the ground-engaging surface 212 of the outsole 210*c* engaging a ground surface when the sole structure 200*c* is not under load (FIG. 17) and when the sole structure 200*c* is under load (FIG. 18). FIG. 17 shows the third series of pins 330 extending through the midsole 220 and the biasing member 250*c* engaging the retention members 306 disposed at the first ends 331 to bias the pins along the third direction toward the insole 260 and into their extended states. While each pin 300 is in the extended state, a gap within the interior void 102 separates the engagement surfaces 309 and the footbed 224. Accordingly, the third series of pins 330 may provide a banking surface for the foot in the interior zone 160 while in the extended state. FIG. 18 shows a ground-reaction force 1800 applied between the lateral side 18 and medial side 20 of the footwear 10*c* that causes the insole 260 to translate from an unloaded position 1802 toward the midsole 220. The translating insole 260 may apply an axial compressive load to the pins 330 that overcomes the biasing of the biasing member 250*c*, thereby allowing the pins 330 to transition to their retracted states while the retention members 306 contact the engagement plate 1600. Accordingly, the engagement plate 1600 compresses the at least one spring 1602 and translates toward the outsole 210*c* to attenuate the ground-reaction force 1800 at the interior regions of the footwear 10*c* between the lateral side 18 and medial side 20. In doing so, the first series of pins 310 (none shown) and the second series 320 (none shown) may be in their extended states to provide banking surfaces for the foot during transitional lateral movements from the interior regions of the footwear 10*c*.

The following Clauses provide an exemplary configuration for the sole structure for an article of footwear described above.

Clause 1: An article of footwear comprising an upper and an outsole attached to the upper and including a ground-engaging surface and an inner surface disposed on an opposite side of the outsole than the ground-engaging surface. The midsole having a footbed opposing the upper to define an interior void therebetween and a bottom surface disposed on an opposite side of the midsole than the footbed and opposing the inner surface of the outsole to define a cavity therebetween, the midsole including a series of channels extending through the bottom surface and the footbed and a series of pins each having a post extending through corresponding ones of the series of channels between a first end and a second end, the first end extending into the cavity outward from the bottom surface of the midsole and the second end extending into the interior void outward from the footbed of the midsole and a resilient member received within the cavity and engaging the first end of each of the series of pins, the resilient member biasing the series of pins in a first direction toward the interior void.

Clause 2: The article of footwear of Clause 1, wherein each of the posts are permitted to move along a longitudinal axis of their respective channel.

Clause 3: The article of footwear of any of the preceding Clauses, wherein the channels include different cross-sectional shapes than the posts.

Clause 4: The article of footwear of any of the preceding Clauses, wherein the channels include the same cross-sectional shape.

Clause 5: The article of footwear of any of the preceding Clauses, wherein at least one of the channels includes a different cross-sectional shape than the other of the channels.

Clause 6: The article of footwear of any of the preceding Clauses, further comprising a bushing disposed within at least one of the series of channels.

Clause 7: The article of footwear of Clause 6, wherein the bushing includes an inner surface opposing and slidably receiving the posts of the pins, the inner surface including a higher coefficient of friction than a material of the midsole.

Clause 8: The article of footwear of Clause 6, wherein the bushing is formed from a harder material than the midsole.

Clause 9: The article of footwear of any of the preceding Clauses, wherein the series of pins include a corresponding retention member disposed at the first end and a corresponding pin head disposed at the second end, the retention members restricting removal of the series of pins from the series of channels and the pin heads including an engagement surface opposing with the footbed of the midsole.

Clause 10: The article of footwear of Clause 9, wherein the pin heads include at least one of a substantially circular cross-section and a substantially polygonal cross-section.

Clause 11: The article of footwear of Clause 9, wherein the engagement surfaces of the pin heads are disposed substantially parallel to a longitudinal axis of the midsole.

Clause 12: The article of footwear of Clause 11, wherein at least one of the pin heads of the series of pins is disposed approximately the same distance from one of a lateral side and a medial side of the midsole as its respective first end.

Clause 13: The article of footwear of Clause 11, wherein at least one of the pin heads of the series of pins is disposed closer to a medial side of the midsole than its respective first end.

Clause 14: The article of footwear of Clause 11, wherein at least one of the pin heads of the series of pins is disposed closer to a lateral side of the midsole than its respective first end.

Clause 15: The article of footwear of Clause 11, wherein at least one of the pin heads of the series of pins is disposed farther from a tip of the midsole associated with toes of a foot than its respective first end.

Clause 16: The article of footwear of Clause 9, wherein at least one of the pin heads contacts one or more adjacent pin heads to restrict rotational movement of the pin head.

Clause 17: The article of footwear of any of the preceding Clauses, wherein at least two of the series of pins are attached to one another to restrict rotational movement of the at least two pins.

Clause 18: The article of footwear of any of the preceding Clauses, wherein the midsole includes a lateral zone located proximate to a lateral side of the midsole, a medial zone located proximate to a medial side of the midsole, and an interior zone disposed between the lateral zone and the medial zone.

Clause 19: The article of footwear of Clause 17, wherein a first portion of the series of pins are disposed within the lateral zone of the midsole and a second portion of the series of pins are disposed within the medial zone of the midsole.

Clause 20: The article of footwear of Clause 18, wherein a third portion of the series of pins are disposed within the interior zone of the midsole.

Clause 21: The article of footwear of any of the preceding Clauses, wherein the resilient member includes one of a slab of polymer foam, a fluid-filled chamber, and a biasing member.

Clause 22: An article of footwear comprising an upper and an outsole attached to the upper and including an inner surface. The midsole having a footbed opposing the upper to define an interior void therebetween and a bottom surface disposed on an opposite side of the midsole than the footbed and opposing the inner surface of the outsole to define a cavity therebetween, the midsole including a lateral zone having a first series of channels extending through the bottom surface and the footbed and a medial zone having a second series of channels extending through the bottom surface and the footbed and a first series of pins each having a first post extending through corresponding ones of the first series of channels in a first direction substantially parallel to a longitudinal axis of the first post and a second series of pins each having a second post extending through corresponding ones of the second series of channels in a second direction substantially parallel to a longitudinal axis of the second post.

Clause 23: The article of footwear of Clause 22, wherein the first direction and the second direction extend away from one another.

Clause 24: The article of footwear of Clause 22, wherein the first direction is substantially parallel to the second direction.

Clause 25: The article of footwear of Clause 22, wherein the first direction and the second direction are converging.

Clause 26: The article of footwear of any of Clauses 22-25, wherein each of the first series of pins and each of the second series of pins include a first end extending into the cavity outward from the bottom surface of the midsole and a second end extending into the interior void outward from the footbed of the midsole, the second ends of the first series of pins disposed closer to a lateral side of side of the midsole than their respective first ends and the second ends of the second series of pins disposed closer to a medial side of the midsole than their respective first ends.

Clause 27: The article of footwear of Clause 26, further comprising a resilient member received within the cavity and biasing the first series of pins along the first direction toward the interior void.

Clause 28: The article of footwear of Clause 27, wherein the resilient member biases the second series of pins along the second direction toward the interior void.

Clause 29: The article of footwear of Clause 27, wherein the resilient member engages the first ends of the first series of pins and the first ends of the second series of pins.

Clause 30: The article of footwear of Clause 27, wherein at least one of the first series of pins is slidably movable along the first direction within its respective channel toward the resilient member when an axial compressive load is applied to the pin.

Clause 31: The article of footwear of Clause 27, wherein at least one of the second series of pins is slidably movable along the second direction within its respective channel toward the resilient member when an axial compressive load is applied to the pin.

Clause 32: The article of footwear of Clause 26, wherein the first series of pins and the second series of pins include a corresponding retention member disposed at the first ends, the retention members restricting removal of the first series of pins from the first series of channels and restricting removal of the second series of pins from the second series of channels.

Clause 33: The article of footwear of Clause 26, wherein the first series of pins and the second series of pins include a corresponding pin head disposed at the second ends, the pin heads including an engagement surface opposing the footbed of the midsole.

Clause 34: The article of footwear of Clause 33, wherein the pin heads include at least one of a substantially circular cross-section and a substantially oval cross-section.

Clause 35: The article of footwear of Clause 33, wherein the pin heads include a substantially polygonal cross-section.

Clause 36: The article of footwear of Clause 33, wherein the engagement surfaces of the pin heads are disposed substantially parallel to a longitudinal axis of the midsole.

Clause 37: The article of footwear of Clause 31, wherein at least one of the pin heads contacts one or more adjacent pin heads to restrict rotational movement of the pin heads.

Clause 38: The article of footwear of Clause 26, wherein the first posts and the second posts extend between the first end and the second end and include different cross-sectional shapes than the channels.

Clause 39: The article of footwear of any of Clauses 22-38, wherein each of the channels includes the same cross-sectional shape.

Clause 40: The article of footwear of any of Clauses 22-38, wherein at least one of the channels includes a different cross-sectional shape than the other of the channels.

Clause 41: The article of footwear of any of Clauses 22-40, further comprising a bushing disposed within at least one of the first series of channels and the second series of channels.

Clause 42: The article of footwear of Clause 41, wherein the bushing includes an inner surface opposing and slidably receiving respective ones of the first posts and the second posts, the inner surface including a higher coefficient of friction than a material of the midsole.

Clause 43: The article of footwear of Clause 41, wherein the bushing is formed from a harder material than the midsole.

Clause 44: The article of footwear of any of Clauses 22-43, wherein at least two of the first series of pins are attached to one another to restrict rotational movement of the at least two pins.

Clause 45: The article of footwear of any of Clauses 22-44, wherein at least two of the second series of pins are attached to one another to restrict rotational movement of the at least two pins.

Clause 46: The article of footwear of any of Clauses 22-45, wherein the midsole further includes an interior zone disposed between the lateral zone and the medial zone, the interior zone having a third series of channels extending through the bottom surface and the footbed, the third series of channels each having a longitudinal axis substantially perpendicular to a longitudinal axis of the midsole.

Clause 47: The article of footwear of Clause 46, further comprising a third series of pins each having a third post extending through corresponding ones of the third series of channels and along the longitudinal axis of each corresponding third series channel, wherein the resilient member biases the third series of pins along a third direction substantially parallel to the longitudinal axis of the third series of channels toward the interior void.

Clause 48: The article of footwear of Clause 47, wherein the third posts include a shorter length than the first posts and the second posts.

Clause 49: The article of footwear of any of Clauses 22-48, wherein the resilient member comprises one of a slab of polymer foam, a fluid-filled chamber, and a biasing member.

Clause 50: A method of making an article of footwear, the method comprising providing an interior void between an upper and a footbed of a midsole and providing a cavity between a bottom surface of the midsole and an outsole, the bottom surface disposed on an opposite side of the midsole than the footbed and providing the midsole with a series of channels extending through the bottom surface and the footbed and providing a series of pins each having a post extending through corresponding ones of the series of channels between a first end and a second end, the pins having a length that is greater than a thickness of the midsole and biasing the series of pins in a first direction toward the interior void.

Clause 51: The method of Clause 50, wherein biasing the series of pins in the first direction includes engaging the first ends with a resilient member received within the cavity.

Clause 52: The method of any of the preceding Clauses, wherein providing the series of pins each having a post includes providing the series of pins each having a post that is movable along a longitudinal axis of its respective channel.

Clause 53: The method of any of the preceding Clauses, wherein providing the midsole with the series of channels includes providing each of the series of channels with different cross-sectional shapes than the posts.

Clause 54: The method of any of the preceding Clauses, wherein providing the midsole with the series of channels includes providing each of the series of channels with the same cross-sectional shape.

Clause 55: The method of any of the preceding Clauses, wherein providing the midsole with the series of channels includes providing at least one of the channels with a different cross-sectional shape than the other of the channels.

Clause 56: The method of any of the preceding Clauses, further comprising providing a bushing disposed within at least one of the series of channels.

Clause 57: The method of Clause 56, wherein providing the bushing includes providing the bushing with an inner surface opposing and slidably receiving the posts of the pins, the inner surface including a higher coefficient of friction than a material of the midsole.

Clause 58: The method of Clause 56, wherein providing the bushing includes providing the bushing formed from a harder material than the midsole.

Clause 59: The method of any of the preceding Clauses, wherein providing the series of pins includes providing the series of pins with a corresponding retention member disposed at the first end and a corresponding pin head disposed at the second end, the retention members restricting removal of the series of pins from the series of channels and the pin heads having an engagement surface opposing the bottom surface of the midsole.

Clause 60: The method of Clause 59, wherein providing the series of pins with a corresponding pin head includes providing the series of pins with a corresponding pin head that includes at least one of a substantially circular cross-section and a substantially polygonal cross-section.

Clause 61: The method of Clause 59, wherein providing the series of pins with a corresponding pin head having an engagement surface includes providing the series of pins with a corresponding pin head each having an engagement surface that is disposed substantially parallel to a longitudinal axis of the midsole.

Clause 62: The method of Clause 61, wherein providing the series of pins with a corresponding pin head includes providing at least one of the series of pins with a corresponding pin head that is disposed approximately the same distance from one of a lateral side and a medial side of the midsole as its respective first end.

Clause 63: The method of Clause 61, wherein providing the series of pins with a corresponding pin head includes providing at least one of the series of pins with a corresponding pin head that is disposed closer to a medial side of the midsole than its respective first end.

Clause 64: The method of Clause 61, wherein providing the series of pins with a corresponding pin head includes providing at least one of the series of pins with a corresponding pin head that is disposed closer to a lateral side of the midsole than its respective first end.

Clause 65: The method of Clause 61, wherein providing the series of pins with a corresponding pin head includes providing at least one of the series of pins with a corresponding pin head that is disposed farther from a tip of the midsole associated with toes of a foot than its respective first end.

Clause 66: The method of Clause 59, wherein providing the series of pins with a corresponding pin head includes providing at least one of the series of pins with a corresponding pin head that contacts one or more adjacent pin heads to restrict rotational movement of the pin heads.

Clause 67: The method of any of the preceding Clauses, wherein providing the series of pins includes attaching at least two of the series of pins to one another to restrict rotational movement of the at least two of the series of pins.

Clause 68: The method of any of the preceding Clauses, further comprising providing the midsole with a lateral zone located proximate to a lateral side of the midsole, a medial zone located proximate to a medial side of the midsole, and an interior zone disposed between the lateral zone and the medial zone.

Clause 69: The method of Clause 68, wherein providing the series of pins includes providing a first portion of the series of pins disposed within the lateral zone of the midsole, and providing a second portion of the series of pins disposed within the medial zone of the midsole.

Clause 70: The method of Clause 69, wherein providing the series of pins includes providing a third portion of the series of pins disposed within the interior zone of the midsole.

Clause 71: The method of any of the preceding Clauses, further comprising providing a resilient member received within the cavity and including one of a slab of polymer foam, a fluid-filled chamber, and a biasing member.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper;

an outsole attached to the upper and including a ground-engaging surface and an inner surface disposed on an opposite side of the outsole than the ground-engaging surface;

a midsole having a footbed opposing the upper to define an interior void therebetween and a bottom surface disposed on an opposite side of the midsole than the footbed and opposing the inner surface of the outsole to define a cavity therebetween, the midsole including a series of channels extending through the bottom surface and the footbed;

a series of pins each having (i) a post extending through corresponding ones of the series of channels between a first end and a second end, the first end extending into the cavity outward from the bottom surface of the midsole and the second end extending into the interior void outward from the footbed of the midsole and (ii) a pin head disposed at the second end and including a planar top surface opposing the upper, a surface area of the top surface being greater than a cross-sectional area of the post, and the planar top surface of at least one of the series of pins oriented at an oblique angle relative to a longitudinal axis of the post of the at least one of the series of pins; and a unitary resilient member (i) received within the cavity, (ii) engaging the first end of each of the series of pins, and (iii) biasing the series of pins in a first direction toward the interior void.

2. The article of footwear of claim 1, wherein each of the posts are permitted to move along a longitudinal axis of their respective channel.

3. The article of footwear of claim 1, further comprising a bushing disposed within at least one of the series of channels.

4. The article of footwear of claim 3, wherein the bushing includes an inner surface opposing and slidably receiving the posts of the pins, the inner surface including a higher coefficient of friction than a material of the midsole.

5. The article of footwear of claim 3, wherein the bushing is formed from a harder material than the midsole.

6. The article of footwear of claim 1, wherein the series of pins include a corresponding retention member disposed at the first end, the retention members restricting removal of the series of pins from the series of channels and the pin heads including an engagement surface opposing with the footbed of the midsole.

7. The article of footwear of claim 1, wherein the pin heads include at least one of a substantially circular cross-section and a substantially polygonal cross-section.

8. The article of footwear of claim 7, wherein at least one of the pin heads of the series of pins is disposed approximately the same distance from one of a lateral side and a medial side of the midsole as its respective first end.

9. The article of footwear of claim 7, wherein at least one of the pin heads of the series of pins is disposed closer to a medial side of the midsole than its respective first end.

10. The article of footwear of claim 7, wherein at least one of the pin heads of the series of pins is disposed closer to a lateral side of the midsole than its respective first end.

11. The article of footwear of claim 1, wherein the resilient member includes one of a slab of polymer foam, a fluid-filled chamber, and a biasing member.

12. The article of footwear of claim 1, wherein at least one of the channels extends through the midsole at an oblique angle relative to a lateral axis of the midsole.

13. A method of making an article of footwear, the method comprising:

providing an interior void between an upper and a footbed of a midsole;

providing a cavity between a bottom surface of the midsole and an outsole, the bottom surface disposed on an opposite side of the midsole than the footbed;

providing the midsole with a series of channels extending through the bottom surface and the footbed;

providing a series of pins each having a post extending through corresponding ones of the series of channels between a first end and a second end, the pins having a length that is greater than a thickness of the midsole and including a corresponding pin head disposed at the second end having a planar top surface opposing the upper, a surface area of the top surface being greater than a cross-sectional area of the post;

orienting the planar top surface of the pin head of at least one pin of the series of pins at an oblique angle relative to a longitudinal axis of the post of the at least one pin of the series of pins;

providing a unitary resilient member within the cavity, the unitary resilient member in contact with the first end of each pin of the series of pins; and biasing the series of pins in a first direction toward the interior void with the resilient member.

14. The method of claim 13, wherein providing the series of pins includes providing the series of pins with a corresponding retention member disposed at the first end, the retention members restricting removal of the series of pins from the series of channels and the pin heads having an engagement surface opposing the bottom surface of the midsole.

15. The method of claim 13, wherein providing the series of pins with a corresponding pin head includes providing the series of pins with a corresponding pin head that includes at least one of a substantially circular cross-section and a substantially polygonal cross-section.

16. The method of claim 13, wherein providing the series of pins with a corresponding pin head includes providing at least one of the series of pins with a corresponding pin head that is disposed approximately the same distance from one of a lateral side and a medial side of the midsole as its respective first end.

17. The method of claim 13, wherein providing the series of pins with a corresponding pin head includes providing at least one of the series of pins with a corresponding pin head that is disposed closer to a medial side of the midsole than its respective first end.

18. The method of claim 13, wherein providing the series of pins with a corresponding pin head includes providing at least one of the series of pins with a corresponding pin head that is disposed closer to a lateral side of the midsole than its respective first end.

19. An article of footwear comprising:

an upper;

an outsole attached to the upper and including a ground-engaging surface and an inner surface disposed on an opposite side of the outsole than the ground-engaging surface;

a midsole having a footbed opposing the upper to define an interior void therebetween and a bottom surface disposed on an opposite side of the midsole than the footbed and opposing the inner surface of the outsole to define a cavity therebetween, the midsole including a series of channels extending through the bottom surface and the footbed;

a series of pins each having (i) a post extending through corresponding ones of the series of channels between a first end and a second end, the first end extending into the cavity outward from the bottom surface of the midsole and the second end extending into the interior void outward from the footbed of the midsole and (ii) a pin head disposed at the second end and including a planar top surface opposing the upper, a surface area of the top surface being greater than a cross-sectional area of the post, the series of pins including:

a first series of pins disposed in an interior zone of the midsole, the post of each pin of the first series of pins extending perpendicular to a lateral axis and a longitudinal axis of the midsole, and the planar top surface of the pin head of each pin of the first series of pins disposed perpendicular to a longitudinal axis of the posts of the first series of pins, and a second series of pins disposed between the first series of pins and one of a medial side and a lateral side of the midsole, the post of each pin of the second series of pins extending at an oblique angle relative to the lateral axis, and the planar top surface of the pin head of each pin of the second series of pins is disposed at an oblique angle relative to a longitudinal axis of the posts of the second series of pins; and a unitary resilient member (i) received within the cavity, (ii) engaging the first end of each of the series of pins, and (iii) biasing the series of pins in a first direction toward the interior void.

* * * * *